United States Patent [19]

Kayanuma et al.

[11] Patent Number: 4,729,219

[45] Date of Patent: Mar. 8, 1988

[54] DOUBLE AIR-FUEL RATIO SENSOR SYSTEM HAVING IMPROVED RESPONSE CHARACTERISTICS

[75] Inventors: Nobuaki Kayanuma, Gotenba; Toshinari Nagai, Susono; Takatoshi Masui; Yoshiki Chujo, both of Mishima; Hironori Bessho, Susono; Yasushi Sato, Mishima; Toshiyasu Katsuno; Toshio Tanahashi, both of Susono, all of Japan

[73] Assignee: Toyota Jidosha Kabushiki Kaisha, Aichi, Japan

[21] Appl. No.: 846,153

[22] Filed: Mar. 31, 1986

[30] Foreign Application Priority Data

Apr. 3, 1985 [JP] Japan ..... 60-69138
Apr. 12, 1985 [JP] Japan ..... 60-76614
May 20, 1985 [JP] Japan ..... 60-105926

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,251,989 | 2/1981 | Norimatsu et al. | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-152147 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, a delay operation is performed upon the output of the downstream-side air-fuel ratio sensor, so that the actual air-fuel ratio is adjusted in accordance with the output of the upstream-side air-fuel ratio sensor and the delayed output of the downstream-side air-fuel ratio sensor.

38 Claims, 55 Drawing Figures

| Fig.6A | Fig.6B | Fig.6C |
|---|---|---|

| Fig.8A | Fig.8B | Fig.8C |
|---|---|---|

| Fig.19A | Fig.19B |
|---|---|

DOUBLE AIR-FUEL RATIO SENSOR SYSTEM HAVING IMPROVED RESPONSE CHARACTERISTICS

BACKGROUND OF THE INVENTION

1.Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2.Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and NOx simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstreamside $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, a reference voltage for the output of the downstream-side $O_2$ sensor is set at an intermediate level between the maximum level and minimum level thereof. In this case, an air-fuel ratio feedback control operation by the downstream-side $O_2$ sensor can be performed upon the output of the downstream-side $O_2$ sensor, which is often reversed within a short period of time. Therefore, such as air-fuel ratio feedback control operation is performed upon a rich spike or a lean spike of the air-fuel ratio, thereby inviting overcorrection of the air-fuel ratio. As a result, the controlled air-fuel ratio may be overrich or overlean, thus deteriorating the fuel consumption, the drivability, and the condition of the exhaust emissions such as HC, CO, and NOx. Also, even when the above-mentioned overcorrection of the controlled air-fuel ratio is relatively small, the control speed of a double $O_2$ sensor system is reduced by a rich spike or a lean spike of the air-fuel ratio, thus deteriorating the functions of the system.

SUMMARY OF THE INVENTION

It is an object of the present invention to provide a double air-fuel ratio sensor ($O_2$ sensor) system which can carry out a proper air-fuel ratio control operation even when the output of the downstream-side air-fuel ratio sensor ($O_2$ sensor) is often reversed within a short period of time.

According to the present invention, in a double air-fuel ratio sensor system including two $O_2$ sensors upstream and downstream of a catalyst converter provided in an exhaust passage, the actual air-fuel ratio is adjusted by using the output of the upstream-side $O_2$ sensor and the output of the downstream-side $O_2$ sensor. In this system, a delay operation is performed upon the output of the downstream-side air-fuel ratio sensor, so that tne actual air-fuel ratio is adjusted in accordance with the output of the upstream-side air-fuel ratio sensor and the delayed output of the downstream-side air-fuel ratio sensor. As a result, reversions such as rich spikes or lean spikes occurring in the downstream-side air-fuel ratio sensor within a short period of time are eliminated by the delay operation upon the output thereof, thus avoiding the overcorrection of the controlled air-fuel ratio and the reduction of the control speed.

BRIEF DESCRIPTION OF THE DRAWINGS

The present invention will be more clearly understood from the description as set forth below with reference to the accompanying drawings, wherein:

FIGS. 6, 6A–6C, 8, 8A–8C, 9, 12, 13, 13A–13D, 14, 16, 16A, 16B, 18, 18A, 18B, 19 and 19A–19D are flow charts showing the operation of the control circuit of FIG. 2;

DESCRIPTION OF THE PREFERRED EMBODIMENTS

Figure 1:
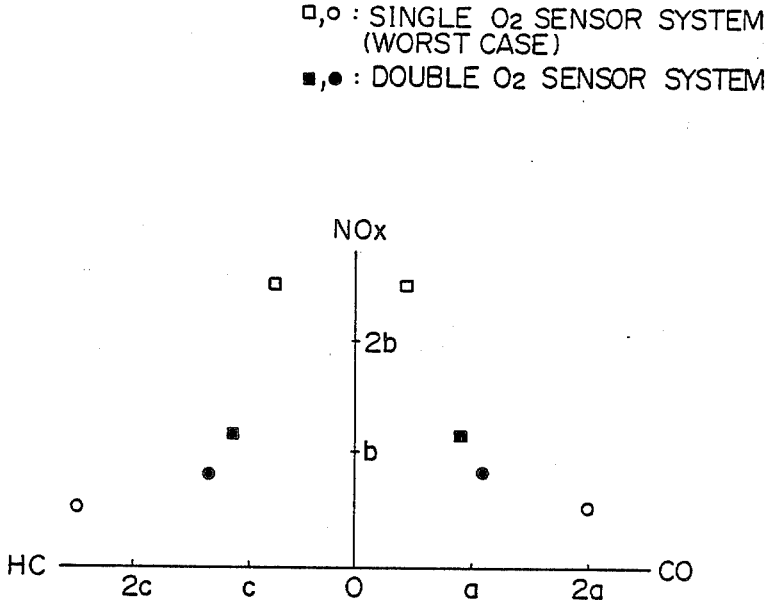
FIG. 1 is a graph showing the emission characteristics of a single $O_2$ sensor system (worst case) and a double $O_2$ sensor system.
Figure 2:
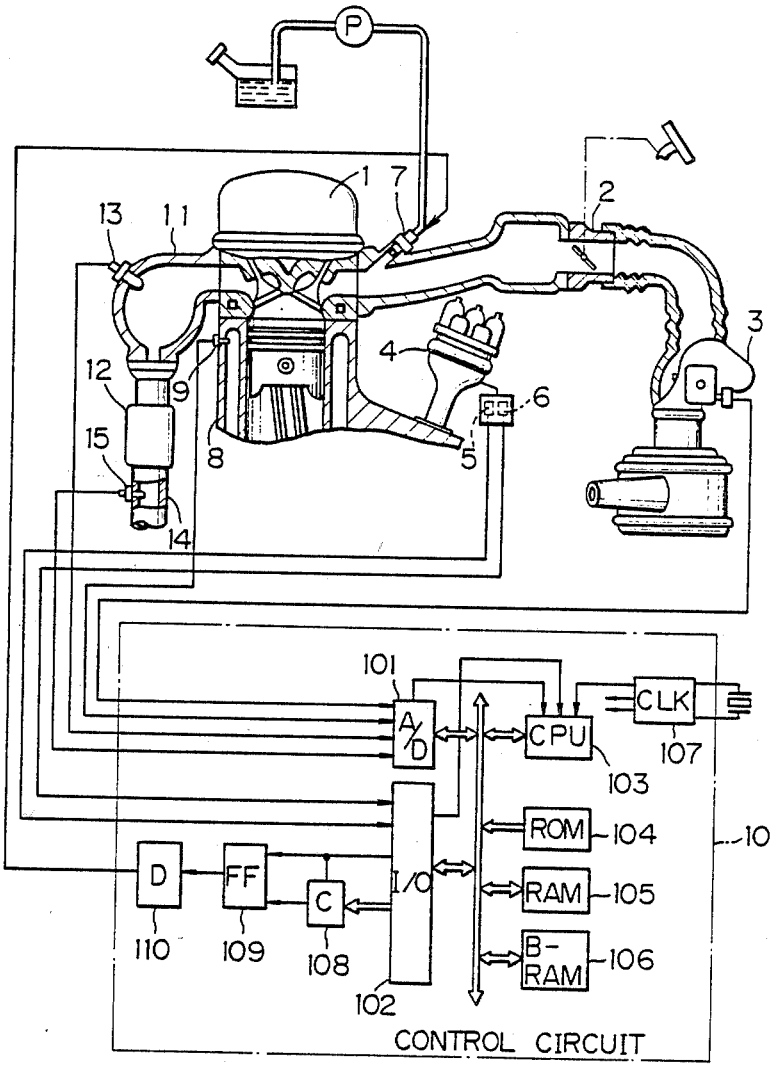
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a centeral processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and NOx simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is calculated in a TAU routine, which will be later explained, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW of the coolant sensor 9, are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The output characteristics of the $O_2$ sensors 13 and 15 will be explained with reference to FIGS. 3, 4, and 5.

Figure 3:
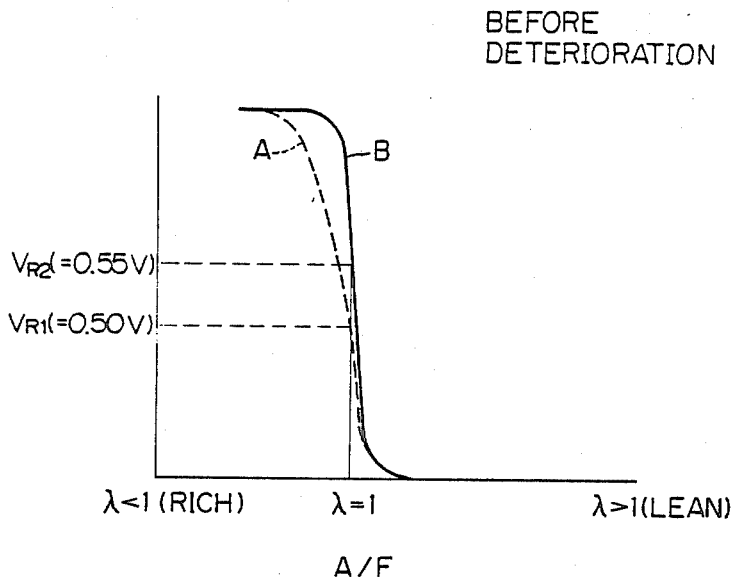
FIGS. 3, 4, and 5 are graphs showing the output characteristics of $O_2$ sensors.

In FIG. 3, curve A shows the output characteristics of the upstream-side $O_2$ sensor 13 before deterioration, and curve B shows the output characteristics of the downstream-side $O_2$ sensor 15 before deterioration. Even before their deterioration, since the exhaust gas is sufficiently mixed on the downstream side of the catalyst converter 12 as compared with on the upstream side thereof, the output characteristics of the downstream-side $O_2$ sensor 15 are superior to those of the upstream-side $O_2$ sensor 13. That is, if each reference voltage for the determination of the output of the $O_2$ sensors 13 and 15 is defined at the stoichiometric air-fuel ratio ($\lambda=1$), the reference voltages $V_{R1}$ and $V_{R2}$ for the output of the $O_2$ sensors 13 and 15, respectively, have the following relationship:

$$V_{R2}>V_{R1}.$$

In this case, the reference voltage $V_{R1}$ is, for example, about 0.50 V, and the reference voltage $V_{R2}$ is, for example, about 0.55 V.

Figure 4:
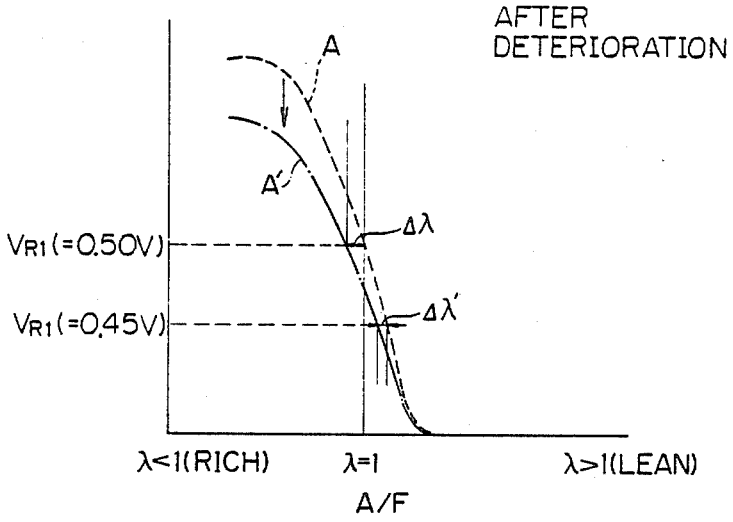

In FIG. 4, curve A shows the output characteristics of the upstream-side $O_2$ sensor 13 before deterioration and curve A' shows the output characteristics of the upstream-side $O_2$ sensor 13 after deterioration. As shown in FIG. 4, if the reference voltage $V_{R1}$ is set at about 0.50 V, which corresponds to the stoichiometric air-fuel ratio ($\lambda=1$) before its deterioration, the controlled air-fuel ratio after the deterioration of the upstream-side $O_2$ sensor 15 is greatly deviated by $\Delta\lambda$ on the rich side from the stoichiometric air-fuel ratio ($\lambda=1$). In order to reduce such a large deviation $\Delta\lambda$ of the controlled air-fuel ratio, the reference voltage $V_{R1}$ is set at a relatively low level such as 0.45 V. In this case, the deviation of the controlled air-fuel ratio after its deterioration is reduced from $\Delta\lambda$ to $\Delta\lambda'$. In this case, although the controlled air-fuel ratio is on the lean side before and after the deterioration of the $O_2$ sensor 13, the controlled air-fuel ratio on the lean side can be moved to the stoichiometric air-fuel ratio by adjusting air-fuel ratio feedback control parameters such as delay time periods, skip amounts, or integration amounts. For example, a rich delay time period is caused to be larger than a lean delay delay time period. Note that the rich delay time period is used for delaying the determination of the upstream-side $O_2$ sensor 13 switched from the lean side to the rich side and the lean delay time period is used for delaying the determination of the upstream-side $O_2$ sensor 13 switched from the rich side to the lean side. Thus, the reference voltage $V_{R1}$ for the output of the upstream-side $O_2$ sensor 13 is actually set at about 0.45 V corresponding to a lean air-fuel ratio.

Figure 5:
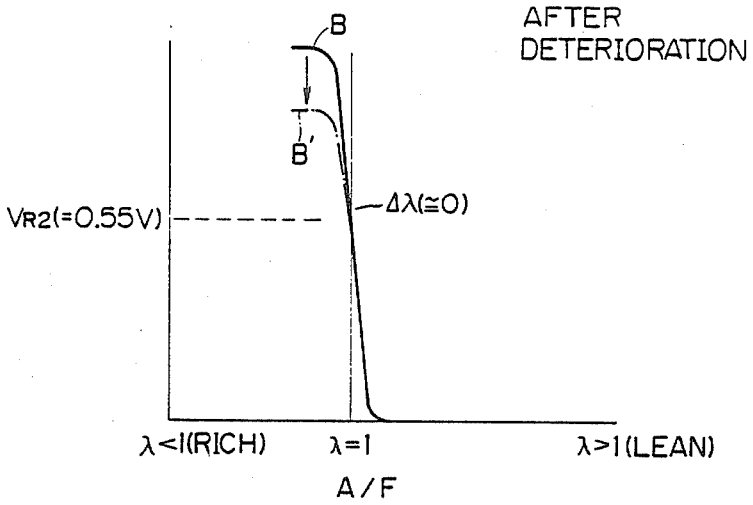

In FIG. 5, curve B shows the output characteristics of the downstream-side $O_2$ sensor 15 before deterioration and curve B' shows the output characteristics of the downstream-side $O_2$ sensor 15 after deterioration. As shown in FIG. 5, the reference voltage $V_{R2}$ set at the stoichiometric air-fuel ratio ($\lambda=1$) is almost unchanged even after the deterioration of the downstream-side $O_2$ sensor 15. In other words, when the reference voltage $V_{R2}$ is set at about 0.55 V, corresponding to the stoichiometric air-fuel ratio ($\lambda=1$) before its deterioration, the controlled air-fuel ratio after the deterioration of the downstream-side $O_2$ sensor 15 is still at the stoichiometric air-fuel ratio ($\Delta\lambda\simeq0$). Thus, the reference voltage $V_{R2}$ is actually set at about 0.55 V.

As explained above, the reference voltage $V_{R1}$ is always set at a level corresponding to a lean air-fuel ratio, while the reference voltage $V_{R2}$ is always set at a level corresponding to the stoichiometric air-fuel ratio.

The operation of the control circuit 2 of FIG. 2 will be now explained.

Figures 6, 6A:
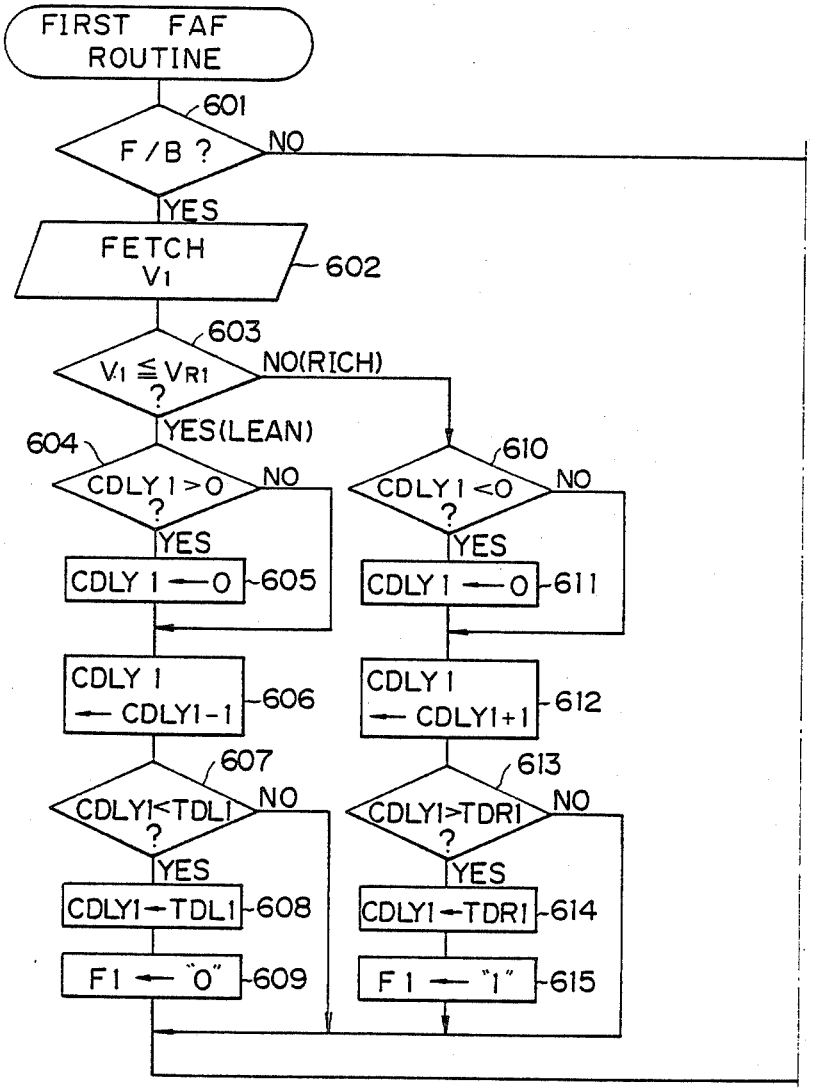
Figure 6B:
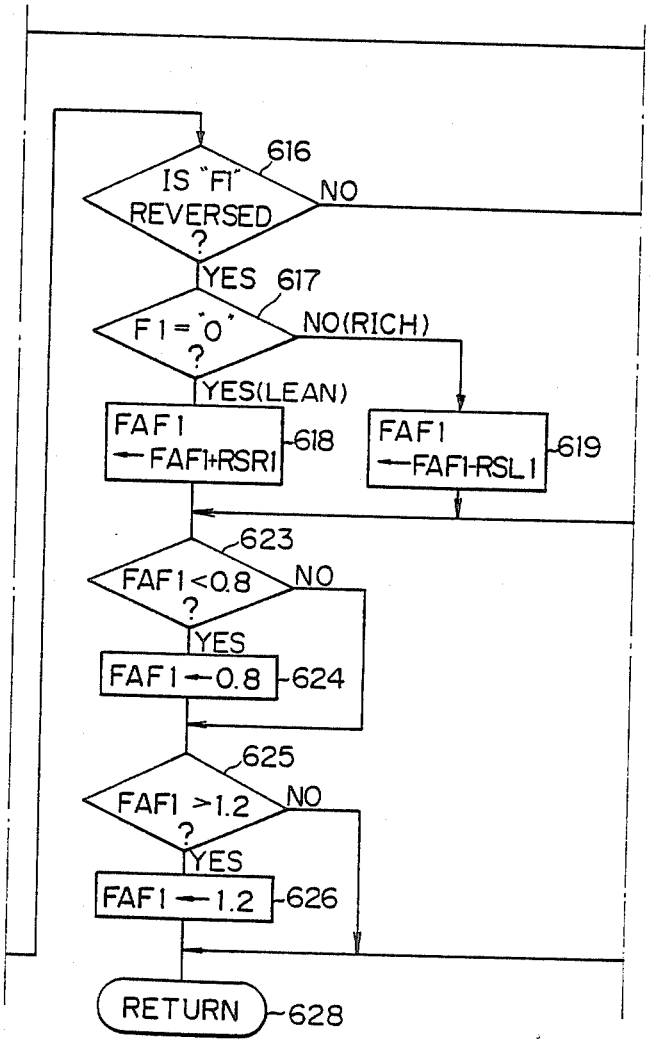
Figure 6C:
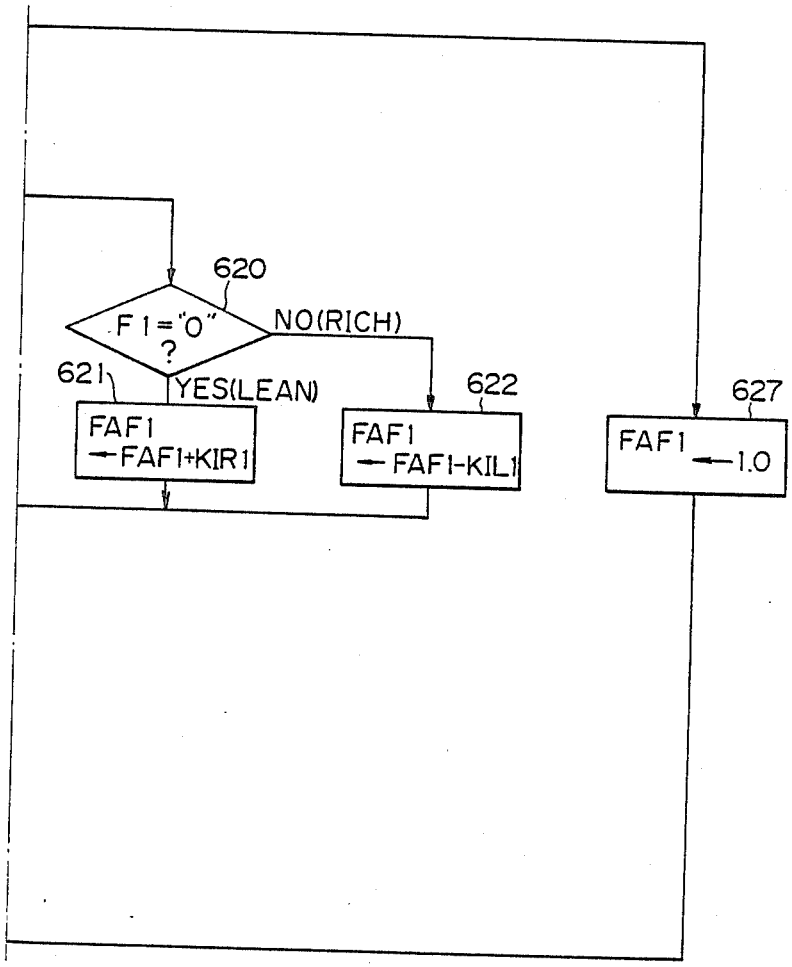

FIG. 6 is a routine for calculating a first air-fuel ratio feedback correction amount FAF1 in accordance with the output of the upstream-side $O_2$ sensor 13 executed at every predetermined time period such as 4 ms.

At step 601, it is determined whether or not all the feedback control (closed-loop control) conditions by the upstream-side $O_2$ sensor 13 are satisfied. The feedback control conditions are as follows (i) the engine is not in a starting state;

(ii) the coolant temperature THW is higher than 50° C.;

(iii) the power fuel incremental amount FPOWER is 0; and (iv) the upstream-side $O_2$ sensor 13 is not in an activated state.

Note that the determination of activation/non-activation of the upstream-side $O_2$ sensor 13 is carried out by determining whether or not the coolant temperature THW $\geqq$70° C., or by whether or not the output of the upstream-side $O_2$ sensor 13 is once swung from the lean side to the rich side, or vice versa. (Of course, other feedback control conditions are introduced as occasion demands. However, an explanation of such other feedback control conditions is omitted.

If one or more of the feedback control conditions is not satisfied, the control proceeds to step 627, in which the correction amount FAF is caused to be 1.0 (FAF1 =1.0), thereby carrying out an open-loop control operation. Note that, in this case, the correction amount FAF1 can be a learning value or a value immediately before the feedback control by the upstream-side $O_2$ sensor 13 is stopped.

Contrary to the above, at step 601, if all of the feedback control conditions are satisfied, the control proceeds to step 602.

At step 602, an A/D conversion is performed upon the output voltage $V_1$ of the upstream-side $O_2$ sensor 13, and the A/D converted value thereof is then fetched from the A/D converter 101. Then, at step 603, the voltage $V_1$ is compared with the reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1\leqq V_{R1}$, which means that the current air-fuel ratio is lean, the control proceeds to step 604, which determines whether or not the value of a first delay counter CDLY1 is positive. If CDLY1>0, the control proceeds to step 605, which clears the first delay counter CDLY1, and then proceeds to step 606. If CDLY1$\leqq$0, the control proceeds directly to step 606. At step 606, the first delay counter CDLY1 is counted down by 1, and at step 607, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 607, only when CDLY1 <TDL1 does the control proceed to step 608, which causes CDLY1 to be TDL1, and then to step 609, which causes a first air-fuel ratio flag F1 to be "0" (lean state). On the other hand, if $V_1>V_{R1}$, which means that the current air-fuel ratio is rich, the control proceeds to step 610, which determines whether or not the value of the first delay counter CDLY1 is negative. If CDLY1<0, the control proceeds to step 611, which clears the first delay counter CDLY1, and then proceeds to step 612. If CDLY1$\geqq$0, the control directly proceeds to 612. At step 612, the first delay counter CDLY1 is counted up by 1, and at step 613, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 613, only when CDLY1>TDR1 does the control proceed to step 614, which causes CDLY1 to be TDR1, and then to step 615, which causes the first air-fuel ratio flag F1 to be "1" (rich state).

Next, at step 616, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 617 to 619, which carry out a skip operation. That is, if the flag F1 is "0" (lean) at step 617, the control proceeds to step 618, which remarkably increases the correction amount FAF1 by a skip amount RSR1. Also, if the flag F1 is "1" (rich) at step 617, the control proceeds to step 619, which remarkably decreases the correction amount FAF1 by the skip amount RSL1. On the other hand, if the first air-fuel ratio flag F1 is not reversed at step 616, the control proceeds to steps 620 to 622, which carries out an integration operation. That is, if the flag F1 is "0" (lean) at step 620, the control proceeds to step 621, which gradually increases the correction amount FAF1 by a rich integration amount KIR1. Also, if the flag F1 is "1" (rich) at step 620, the control proceeds to step 622, which gradually decreases the correction amount FAF1 by a lean integration amount KIL1.

Note that the skip amount RSR1 (RSL1) is larger than the integration amount KIR1 (KIL1).

The correction amount FAF1 is guarded by a minimum value 0.8 at steps 623 and 624, and by a maximum value 1.2 at steps 625 and 626, thereby also preventing the controlled air-fuel ratio from becoming overrich or overlean.

The correction amount FAF1 is then stored in the RAM 105, thus completing this routine of FIG. 6 at step 628.

Figures 7A, 7B, 7C, 7D:
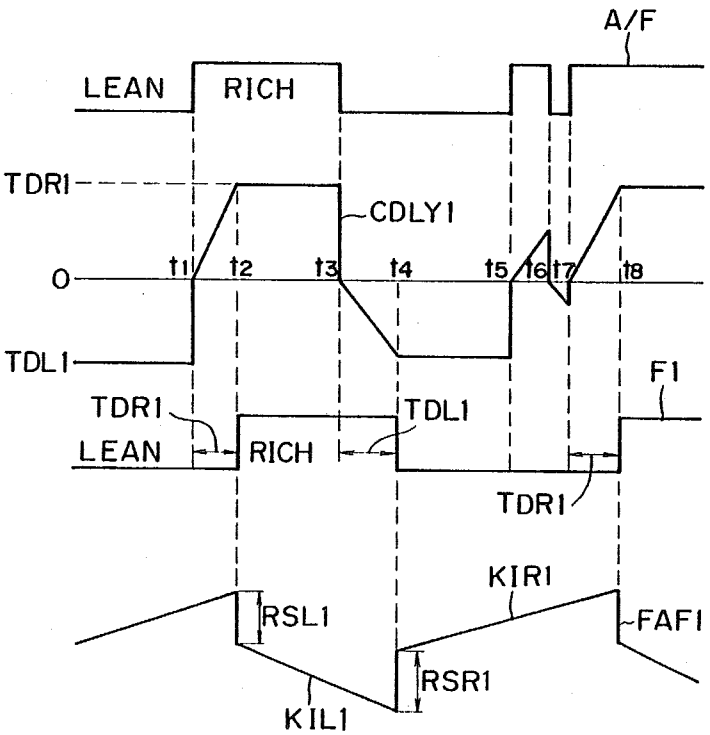
FIGS. 7A through 7D are timing diagrams explaining the flow chart of FIG. 6.

The operation by the flow chart of FIG. 6 will be further explained with reference to FIGS. 7A through 7D. As illustrated in FIG. 7A, when the air-fuel ratio A/F is obtained by the output of the upstream-side $O_2$ sensor 13, the fist delay counter CDLY1 is counted up during a rich state, and is counted down during a lean state, as illustrated in FIG. 7B. As a result, a delayed air-fuel ratio corresponding to the first air-fuel ratio flag F1 is obtained as illustrated in FIG. 7C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 7D, at every change of the delayed air-fuel ratio F1 from the rich side to the lean side, or vice versa, the correction amount FAF1 is skipped by the skip amount RSR1 or RSL1, and also, the correction amount FAF1 is gradually increased or decreased in accordance with the delayed air-fuel ratio F1.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR1 and the lean skip amount RSL1), and an integration amount KI (in more detail, the rich integration amount KIR1 and the lean integration amount KIL1).

For example, if the rich delay time period becomes larger than the lean delay time period (TDR1 >TDL1), the controlled air-fuel ratio becomes richer, and if the lean delay time period becomes larger than the rich delay time period (TDL1 >TDR1), the controlled air-fuel ratio becomes leaner. Thus the air-fuel ratio can be controlled by changing the rich delay time period TDR1 and the lean delay time period TDL1 in accordance with the output of the downstream-side $O_2$ sensor 15. Also, if the rich skip amount RSR1 is increased or if the lean skip amount RSL1 is decreased, the controlled air-fuel ratio becomes richer, and if the lean skip amount RSL is increased or if the rich skip amount RSR1 is decreased, the controlled air-fuel ratio becomes leaner. Thus, the air-fuel ratio can be controlled by changing the rich skip amount RSR1 and the lean skip amount RSL1 in accordance with the output of the downstream-side $O_2$ sensor 15. Further, if the rich integration amount KIR1 is increased or if the lean integration amount KIL1 is decreased, the controlled air-fuel ratio becomes richer, and if the lean integration amount KIL1 is increased or if the rich integration amount KIR1 is decreased, the controlled air-fuel ratio becomes leaner. Thus, the air-fuel ratio can be controlled by changing the rich integration amount KIR1 and the lean integration amount KIL1 in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 8 and 9.

Figures 8, 8A:
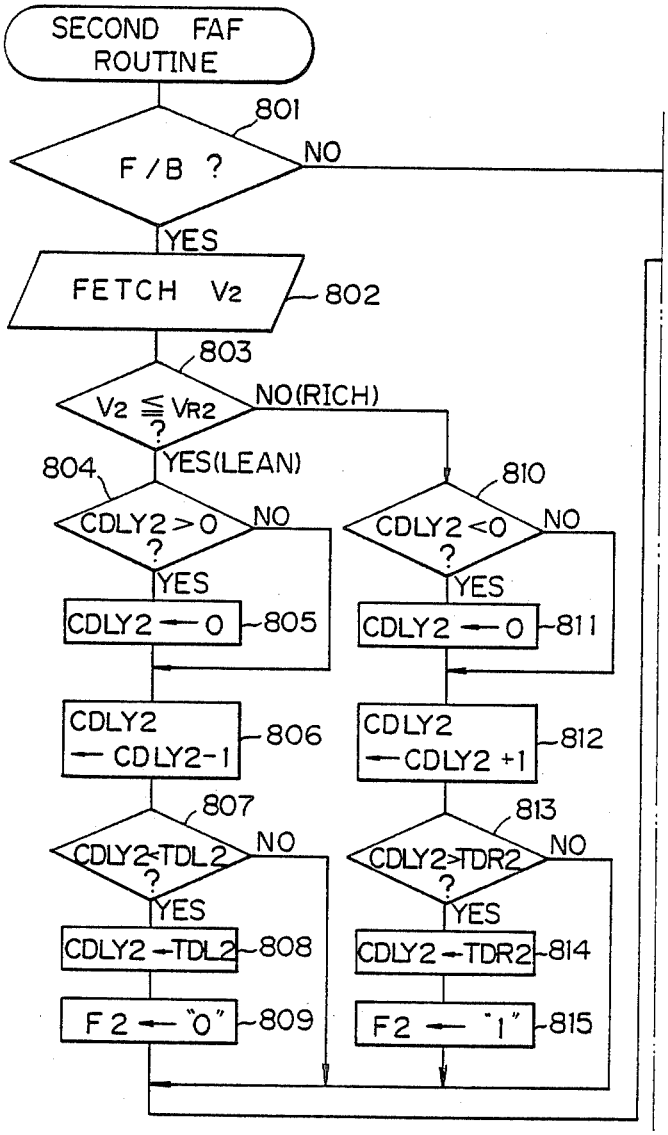
Figure 8B:
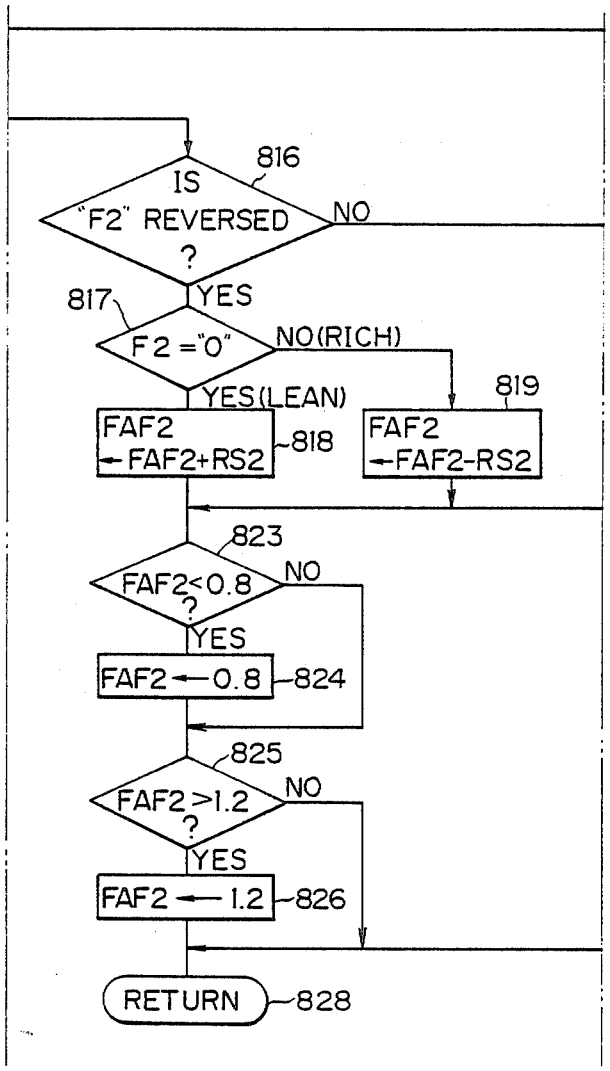
Figure 8C:
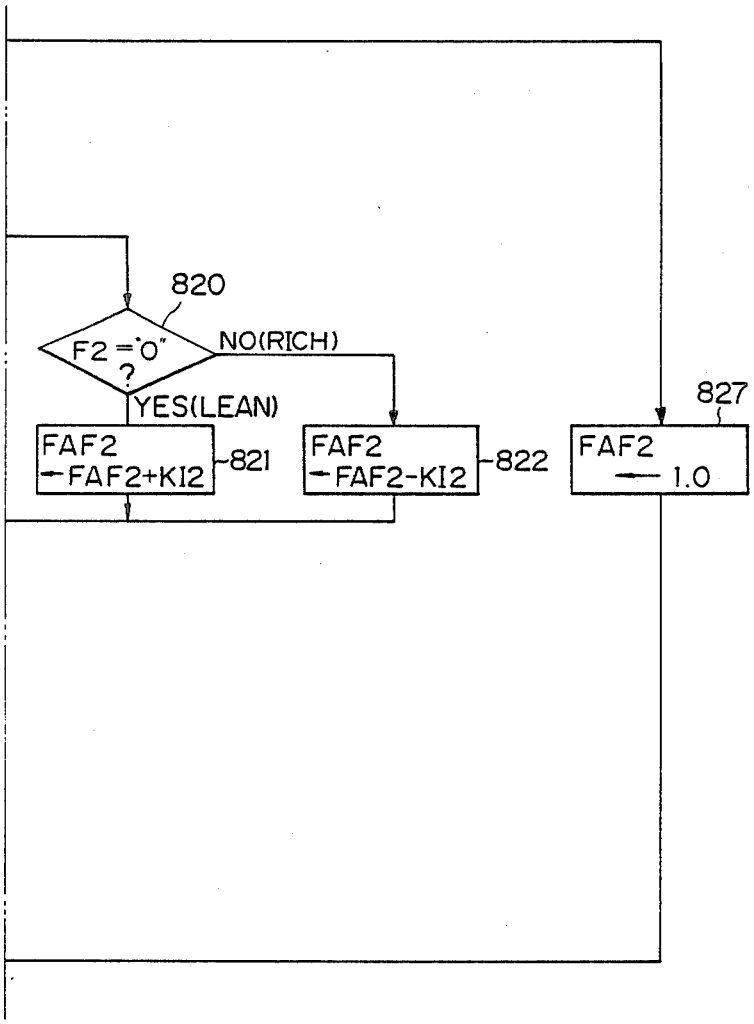

FIG. 8 is a routine for calculating a second air-fuel ratio feedback correction amount FAF2 in accordance with the output of the downstream-side $O_2$ sensor 15 executed at every predetermined time period such as 1 s.

At step 801, it is determined whether or not all the feedback control (closed-loop control) conditions by the downstream-side $O_2$ sensor 15 are satisfied. The feedback control conditions are as follows:

(i) the engine is not in a starting state;
(ii) the coolant temperature THW is higher than 50° C.;
(iii) the power fuel increment FPOWER is 0; and
(iv) the second $O_2$ sensor 15 is not in an activated state.

Note that the determination of activation/nonactivation of the second $O_2$ sensor 15 is carried out by determining whether or not the coolant temperature THW ≧70° C., or by whether or not the output of the downstream-side $O_2$ sensor 15 is once swung from the lean side to the rich side, or vice versa. Of course, other feedback control conditions are introduced as occasion demands. However, an explanation of such other feedback control conditions is omitted.

If one or more of the feedback control conditions is not satisfied, the control proceeds to step 627 in which the correction amount FAF2 is caused to be 1.0 (FAF2=1.0), thereby carrying out an open-loop control operation. Note that, also in this case, the correction amount FAF2 can be a learning value or a value immediately before the feedback control by the downstream-side $O_2$ sensor 15 is stopped.

Contrary to the above, at step 801, if all of the feedback control conditions are satisfied, the control proceeds to step 802. That is, when the engine is switched from an open-loop control to a closed-loop control, the flow at step 801 proceeds to step 802.

At step 802, an A/D conversion is performed upon the output voltage $V_2$ of the downstream-side $O_2$ sensor 15, and the A/D converted value thereof is then fetched from the A/D converter 101. Then, at step 803, the voltage $V_2$ is compared with the reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio.

Steps 804 through 815 correspond to steps 604 through 615, respectively, thereby performing a delay operation upon the determination at step 803. Here, a rich delay time period is defined by TDR2, and a lean delay time period is defined by TDL2 As a result of the delayed determination, if the air-fuel ratio is rich, a second air-fuel ratio flag F2 is caused to be "1", and if the air-fuel ratio is lean, a second air-fuel ratio flag F2 is caused to be "0".

Next, at step 816, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 817 to 819 which carry out a skip operation. That is, if the flag F2 is "0" (lean) at step 817, the control proceeds to step 818, which remarkably increases the second correction amount FAF2 by a skip amount RS2. Also, if the flag F2 is "1" (rich) at step 817, the control proceeds to step 819, which remarkably decreases the second correction amount FAF2 by the skip amount RS2. On the other hand, if the second air-fuel ratio flag F2 is not reversed at step 816, the control proceeds to steps 820 to 822, which carries out an integration operation. That is, if the flag F2 is "0" (lean) at step 820, the control proceeds to step 821, which gradually increases the second correction amount FAF2 by an integration amount KI2. Also, if the flag F2 is "1" (rich) at step 820, the control proceeds to step 822, which gradually decreases the second correction amount FAF2 by the integration amount KI2.

Note that the skip amount RS2 is larger than the integration amount KI2.

The second correction amount FAF2 is guarded by a minimum value 0.8 at steps 823 and 824, and by a maximum value 1.2 at steps 825 and 826, thereby also preventing the controlled air-fuel ratio from becoming overrich or overlean.

The correction amount FAF2 is then stored in the RAM 105, thus completing this routine of FIG. 8 at step 828.

Figure 9:
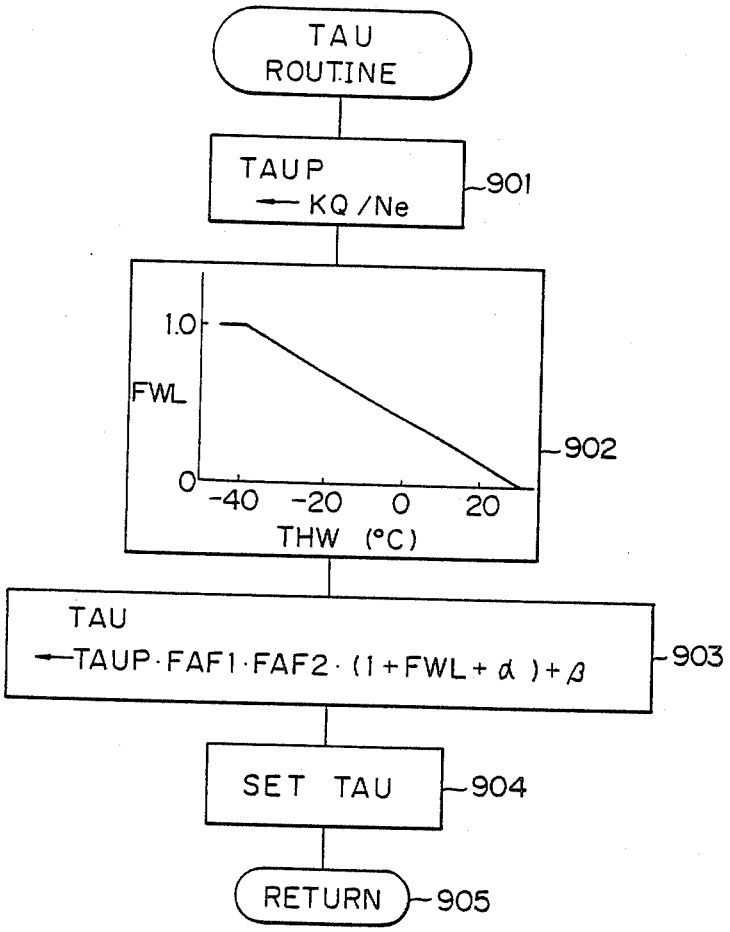

FIG. 9 is a routine for calculating a fuel injection amount TAU executed at every predetermined crank angle such as 360° CA. At step 901, a base fuel injection amount TAUP is calculated by using the intake air amount data Q and the engine speed data Ne stored in the RAM 105. That is, $$TAUP \leftarrow KQ/Ne$$

where K is a constant. Then at step 902, a warming-up incremental amount FWL is calculated from a one-dimensional map by using the coolant temperature data THW stored in the RAM 105. Note that the warming-up incremental amount FWL decreases when the coolant temperature THW increases. At step 903, a final fuel injection amount TAU is calculated by $$TAU \leftarrow TAUP \cdot FAF1 \cdot FAF2 \cdot (1+FWL+\alpha)+\beta$$

where $\alpha$ and $\beta$ are correction factors determined by other parameters such as the voltage of the battery and the temperature of the intake air. At step 904, the final fuel injection amount TAU is set in the down counter 108, and in addition, the flip-flop 109 is set to initiate the activation of the fuel injection valve 7. Then, this routine is completed by step 905. Note that, as explained above, when a time period corresponding to the amount TAU passes, the flip-flop 109 is reset by the carry-out signal of the down counter 108 to stop the activation of the fuel injection valve 7.

Figures 10A, 10B, 10C, 10D:
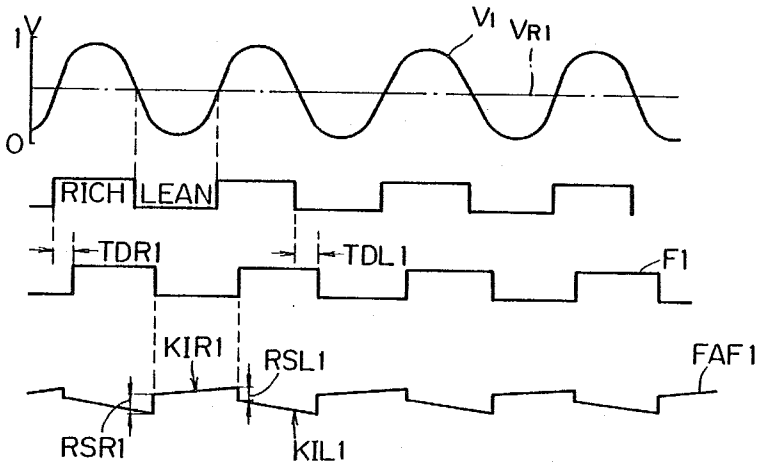
FIGS. 10A through 10H and FIGS. 11A through 11E are timing diagrams explaining the flow charts of FIGS. 6, 8, and 9.
Figures 10E, 10F, 10G, 10H:
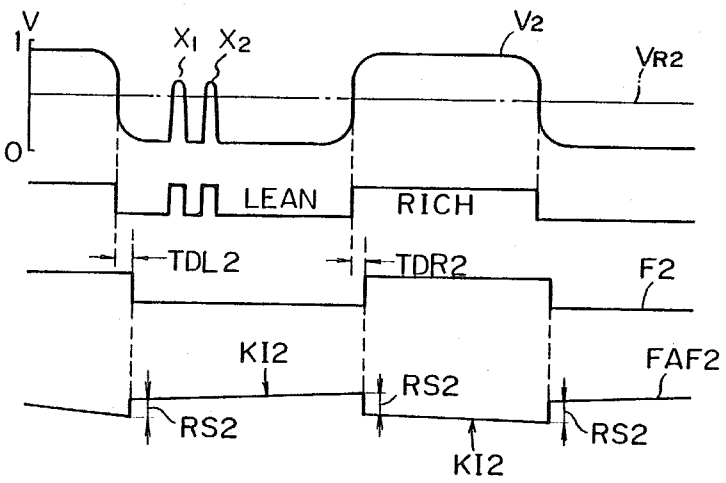

FIGS. 10A through 10H are timing diagrams for explaining the two air-fuel ratio correction amounts FAF1 and FAF2 obtained by the flow charts of FIGS. 6, 8, and 9. In this case, the engine is in a closed-loop control state for the two $O_2$ sensors 13 and 15. When the output of the upstream-side $O_2$ sensor 13 is changed as illustrated in FIG. 10A, the determination at step 603 of FIG. 6 is shown in FIG. 10B, and a delayed determination thereof corresponding to the first air-fuel ratio flag F1 is shown in FIG. 10C. As a result, as shown in FIG. 10D, every time the delayed determination is changed from the rich side to the lean side, or vice versa, the first air-fuel ratio correction amount FAF1 is skipped by the skip amount RSR1 or RSL1. On the other hand, when the output of the downstream-side $O_2$ sensor 15 is changed is illustrated in FIG. 10E, the determination at step 803 of FIG. 8 is shown in FIG. 10F, and the delayed determination thereof corresponding to the second air-fuel ratio flag F2 is shown in FIG. 10G. Thus, in the delayed determination as shown in FIG. 10G, rich spikes as indicated by $X_1$ and $X_2$ in FIG. 10E are eliminated. As a result, as shown in FIG. 10H, every time the delayed determination is changed from the rich side to the lean side, or vice versa, the second air-fuel ratio correction amount FAF2 is skipped by the skip amount RS2.

Figure 11A:
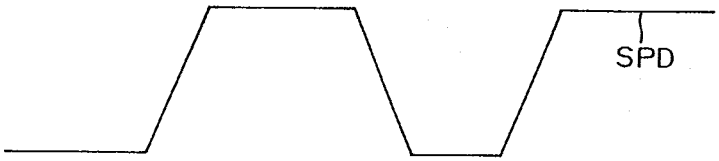
Figure 11B:
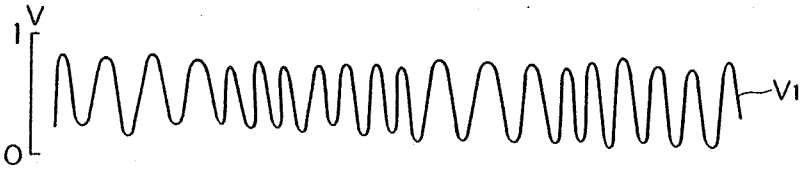
Figure 11C:
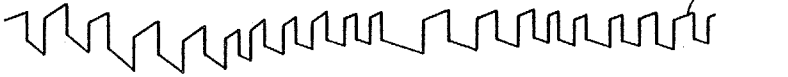
Figure 11D:
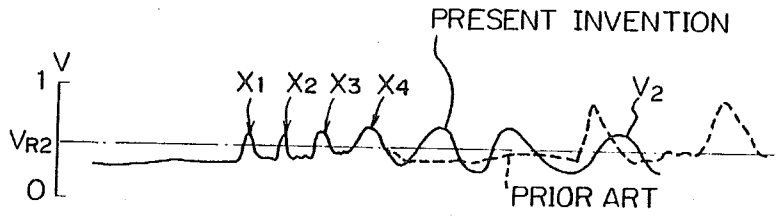
Figure 11E:
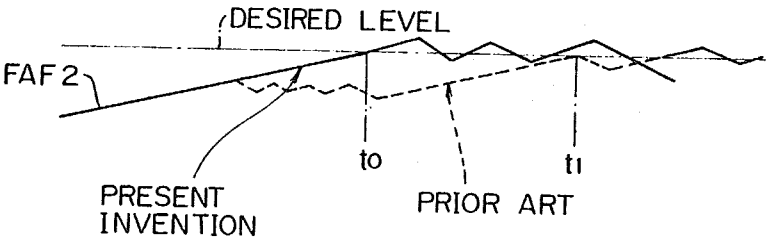

Further, the improvement of the control speed will be explained with reference to FIGS. 11A through 11E. It is assumed that the vehicle speed SPD is changed as shown in FIG. 11A. In this case, the output $V_1$ of the upstream-side $O_2$ sensor 13 is changed as shown in FIG. 11B, and accordingly, the first air-fuel ratio correction amount FAF1 is changed as shown in FIG. 11C. In this state, when the output $V_2$ of the downstream-side $O_2$ sensor 15 is changed as shown in FIG. 11D, i.e., when rich spikes $X_1$, $X_2$, $X_3$, and $X_4$ are generated in the output $V_2$ of the downstream-side $O_2$ sensor 15, if a delay operation is not performed thereupon, such rich spikes may cross over the reference voltage $V_{R2}$, thereby controlling the air-fuel ratio on the lean side as indicated by a dotted line in FIG. 11E. As a result, the second air-fuel ratio correction amount FAF2 reaches its desired level laboriously at time $t_1$. Contrary to this, if a delay operation is performed upon the output $V_2$ of the downstream-side $O_2$ sensor 15, such rich spikes do not affect the controlled air-fuel ratio, and therefore, the controlled air-fuel ratio promptly reaches its desired level at time $t_0$ as indicated by a solid line in FIG. 11E.

Figure 12:
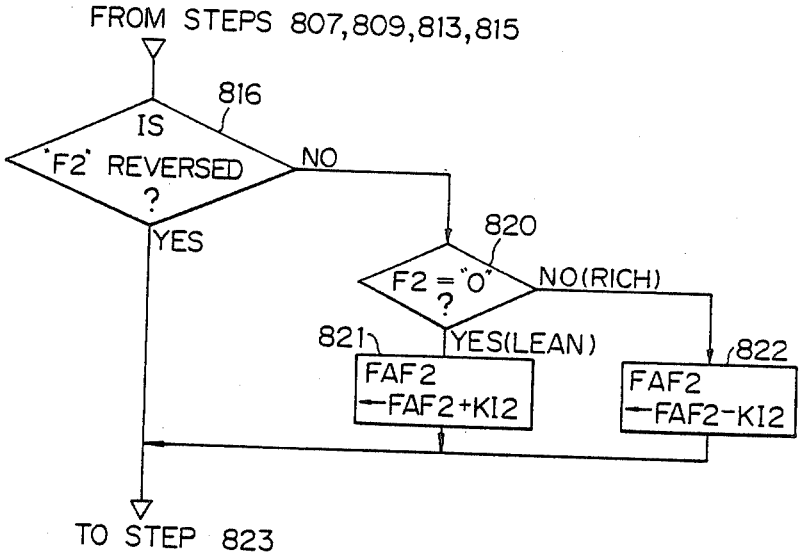

Generally, when the intake air amount Q is rapidly changed due to the acceleration or deceleration, or the switchover of gears, the change of fuel cannot sufficiently follow the change of the intake air amount Q, thus greatly changing the controlled air-fuel ratio. Also, in a double $O_2$ sensor system, the catalyst converter cannot absorb the large change of the air-fuel ratio, thereby changing the output $V_2$ of the downstream-side $O_2$ sensor 15. Note that, originally, the down-stream-side $O_2$ sensor 15 responds to a smooth change of the air-fuel ratio, to compensate for that change. Therefore, preferably, the downstream-side $O_2$ sensor 15 does not respond to a rapid change of the air-fuel ratio. In view of this, the air-fuel ratio feedback control the downstream-side $O_2$ sensor 15 can be substantially stopped when this $O_2$ sensor 15 detects a rapid change of the air-fuel ratio. That is, as illustrated in FIG. 12, which is a modification of FIG. 8, when the delayed output V of the downstream-side $O_2$ sensor 15 is changed, i.e., when the second air-fuel ratio flag F2 is reversed, the flow at step 816 proceeds directly to step 823, thereby not performing a change upon the second air-fuel ratio correction amount FAF2, thus substantially stopping the second air-fuel ratio feedback control.

A double Osensor system, in which an air-fuel ratio feedback control constant of the first air-fuel ratio feedback control by the upstream-side $O_2$ sensor is variable, will be explained with reference to FIGS. 13 and 14. In this case, the delay time periods TDR1 and TDL1 as the air-fuel ratio feedback control parameters are variable.

Figures 13, 13A, 13B:
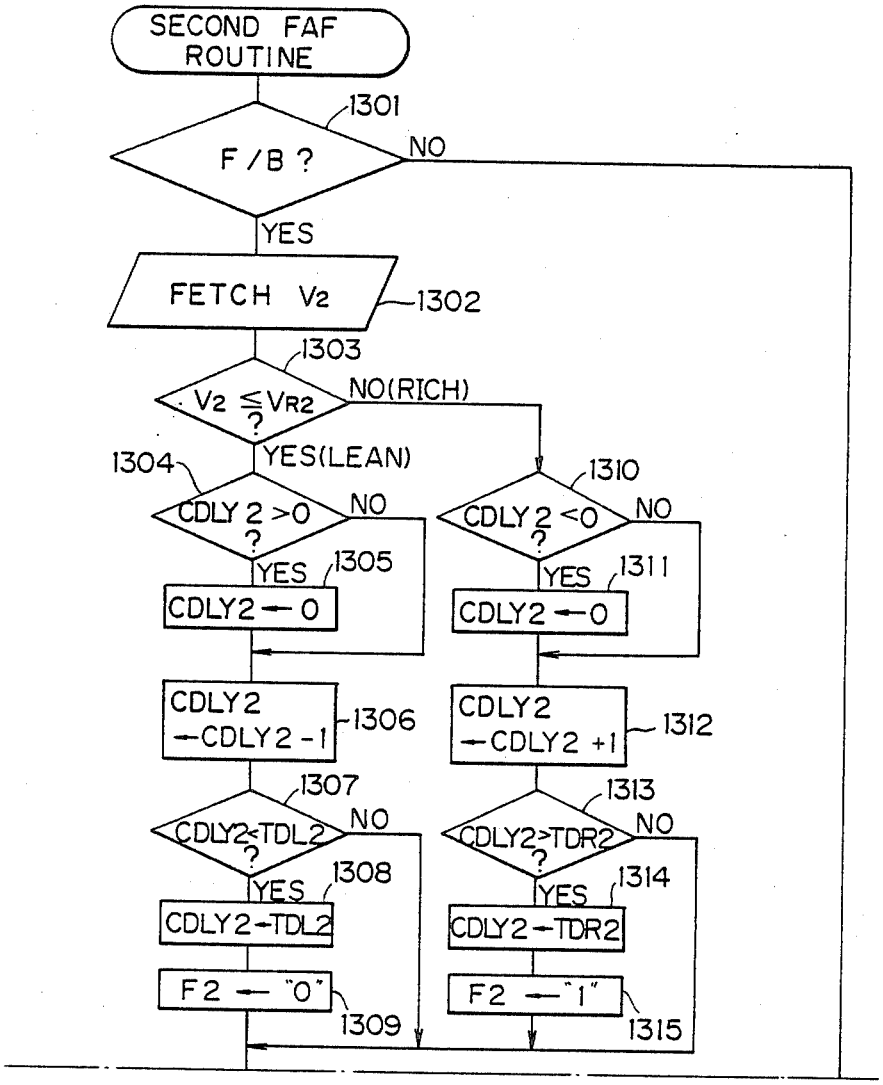
Figure 13B:
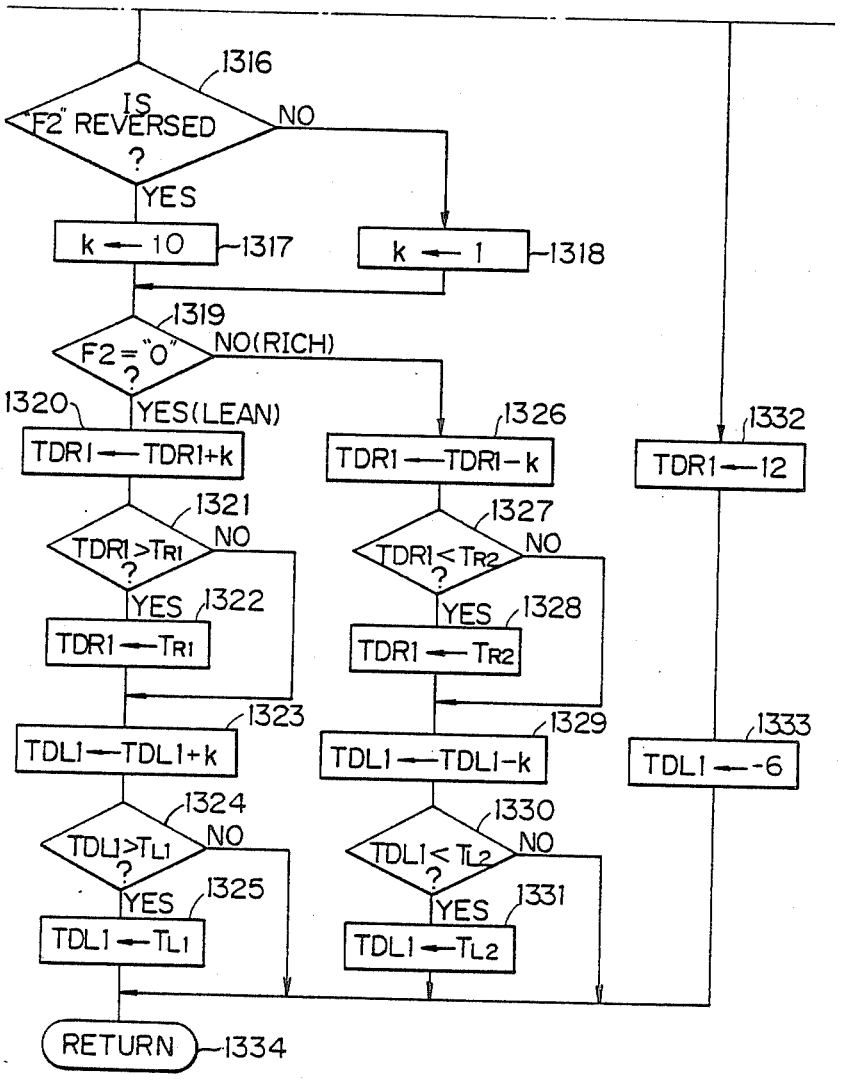

FIGS. 13A and 13B illustrate a routine for calculating the delay time periods TDR1 and TDL1 in accordance with the output of the downstream-side $O_2$ sensor 15 executed at every predetermined time period such as 1 s.

Steps 1301 through 1315 are the same as steps 801 through 815 of FIG. 5. That is, if one or more of the feedback control conditions is not satisfied, the control proceeds to step 1332 in which the rich delay time period TDR1 is caused to be a definite value such as 12 corresponding to 48 ms and also proceeds to step 1333 in which the lean delay time period TDL1 is caused to be a definite value such as −6 corresponding to 24 ms, thereby carrying out an open-loop control for the downstream-side $O_2$ sensor 15.

Contrary to the above, at step 1301, if all of the feedback control conditions are satisfied, the control proceeds to step 1302.

Steps 1302 through 1307 correspond to steps 502 through 507, respectively, of FIG. 5. That is, when the engine is switched from an open-loop control to a closed-loop control, the flow at step 1301 proceeds to step 1302.

Steps 1302 through 1315 correspond to steps 802 through 815, respectively, of FIG. 8. That is, at steps 1304 through 1315, a delay operation is performed upon the determination at step 1303. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

At step 1316, it is determined whether or not the second air-fuel ratio flag F2 is reversed. If the flag F2 is reversed, the control proceeds to step 1317 in which a parameter k is caused to be 10, while if the flag F2 is not reversed, the control proceeds to step 1318 in which a parameter k is caused to be 1. Note that the parameter k is used for correcting the delay time periods TDR1 and TDL1. In this case, if k = 10, the delay time periods are remarkably changed, that is, a skip operation is performed upon the delay time periods. Contrary to this, if k = 1, the delay time periods are gradually changed, that is, an integration operation is performed upon the delay time periods. However, as explained above, in order to substantially stop the second air-fuel ratio feedback control when a rapid change of the air-fuel ratio is detected by the downstream-side $O_2$ sensor 15, the control can proceeds directly to step 1334, when the determination at step 1316 is affirmative.

At step 1319, it is determined whether or not the second air-fuel ratio F2 is "0". If F2 = "0", which means that the air-fuel ratio is lean, the control proceeds to steps 1320 through 1325, and if F2 = "1", which means that the air-fuel ratio is rich, the control processes to steps 1326 through 1331.

At step 1320, the rich delay time period TDR1 is increased by k to move the air-fuel ratio to the rich side. At steps 1321 and 1322, the rich delay time period TDR1 is guarded by a maximum value $T_{R1}$. Note that the value $T_{R1}$ is positive, and accordingly, the value $-T_{R1}$ means a maximum rich delay time period. Further, at step 1323, the lean delay time period TDL1 is increased by k to move the air-fuel ratio to the rich side. At steps 1324 and 1325, the lean delay time period TDL1 is guarded by a maximum value $T_{L1}$. Note that the value $T_{L1}$ is negative, and accordingly, the value means a minimum lean delay time period.

On the other hand, at step 1326, the rich delay time period TDR1 is decreased by k to move the air-fuel ratio to the lean side. At steps 1327 and 1328, the rich delay time period TDR1 is guarded by a minimum value $T_{R2}$. Note that the value $T_{R2}$ is also positive, and accordingly, the value $T_{R2}$ means a minimum rich delay time period. Further, at step 1829, the lean delay time period TDL1 is decreased by k to move the air-fuel ratio to the lean side. At steps 1330 and 1331, the lean delay time period TDL1 is guarded by a minimum value $T_{L2}$. Note that the value $T_{L1}$ is also negative, and accordingly, the value $(-T_L)$ means a maximum lean delay time period.

The delay time period TDR1 and TDL1 are then stored in the RAM 105, thereby completing this routine of FIG. 13 at step 1334.

Figure 14:
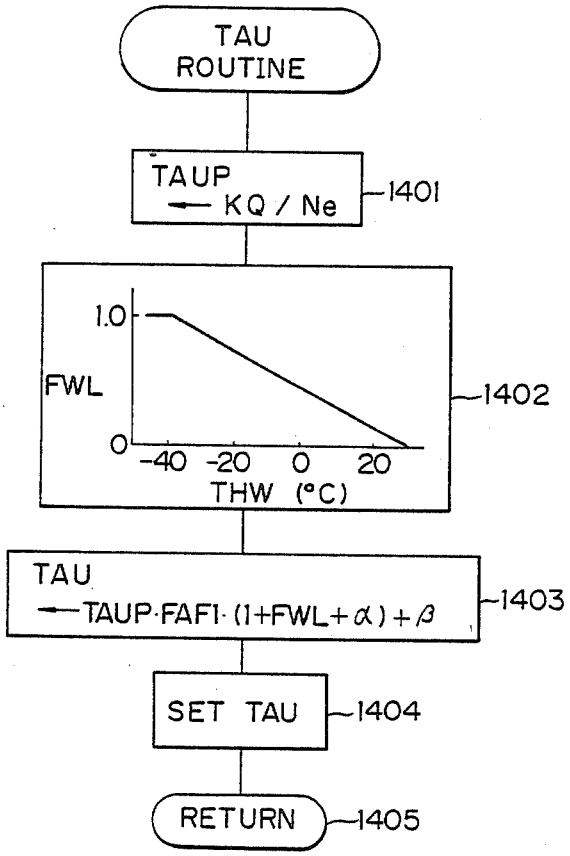

FIG. 14 is a routine for calculating a fuel injection amount TAU executed at every predetermined crank angle such as 360° CA. At step 1401, a base fuel injection amount TAUP is calculated by using the intake air amount data Q and the engine speed data Ne stored in the RAM 105. That is, $$TAUP—KQ/Ne$$

where K is a constant. Then at step 1402, a warming-up incremental amount FWL is calculated from a one-dimensional map by using the coolant temperature data THW stored in the RAM 105. Note that the warming-up incremental amount FWL decreases when the coolant temperature THW increases. At step 1403, a final fuel injection amount TAU is calculated by $$TAU \leftarrow TAUP \cdot FAF1 \cdot (1+FWL+\alpha)+\beta$$

where $\alpha$ and $\beta$ are correction factors determined by other parameters such as the voltage of the battery and the temperature of the intake air. At step 1404, the final fuel injection amount TAU is set in the down counter 108, and in addition, the flip-flop 109 is set to initiate the activation of the fuel injection valve 7. Then, this routine is completed by step 1405. Note that, as explained above, when a time period corresponding to the amount TAU has passed, the flip-flop 109 is reset by the carry-out signal of the down counter 108 to stop the activation of the fuel injection valve 7.

Figures 15A, 15B, 15C, 15D:
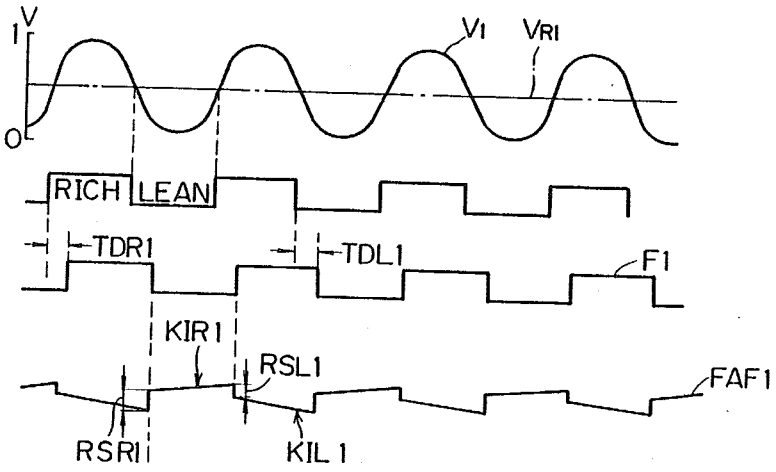
FIGS. 15A through 15H are timing diagrams explaining the flow charts of FIGS. 6, 13 and 14.
Figures 15E, 15F, 15G, 15H:
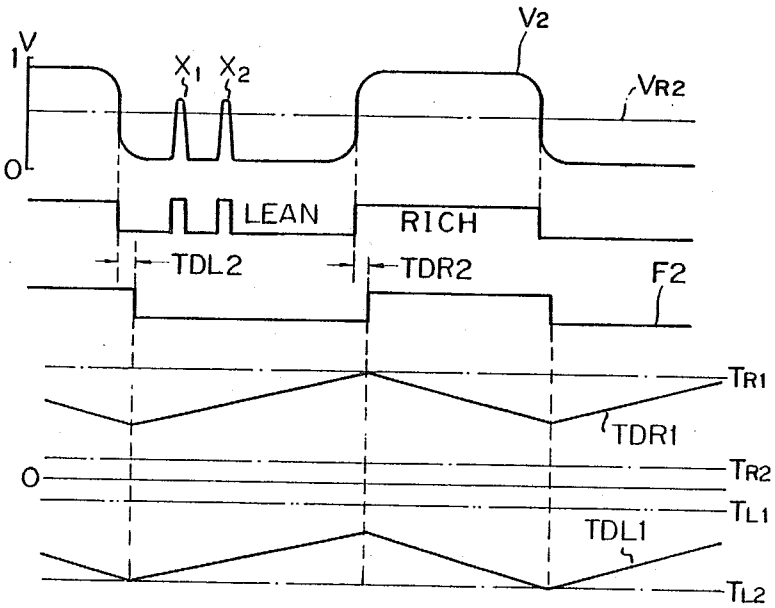

FIGS. 15A through 15H are timing diagrams for explaining the air-fuel ratio correction amount FAF1 and the delay time periods TDR1 and TDL1 obtained by the flow charts of FIGS. 6, 13, and 14. FIGS. 15A through 15G are the same as FIGS. 10A through 10G, respectively, of FIG. 10. That is, in the delayed determination as shown in FIG. 15G, rich spikes as indicated by $X_1$ and $X_2$ in FIG. 15E are eliminated. Thus, as shown in FIGS. 15G and 15H, when the delayed determination F2 is lean, both of the delay time periods TDR1 and TDL1 are decreased, and when the delayed determination F2 is rich, both of the delay time periods TDR1 and TDL1 are decreased. In this case, the rich delay time period TDR1 is changed within a range of from $T_{R1}$ to $T_{R2}$, and the lean delay time period TDL1 is changed within a range of from $T_{L1}$ to $T_{L2}$. Note that FIGS. 15G and 15H show the case where a skip operation is not performed upon the delay time periods TDR1 and TDL1.

Note that the calculated parameters FAF1 and FAF2, or FAF1, TDR1, and TDL1 can be stored in the backup RAM 106, thereby improving drivability at the restarting of the engine.

Figure 16A:
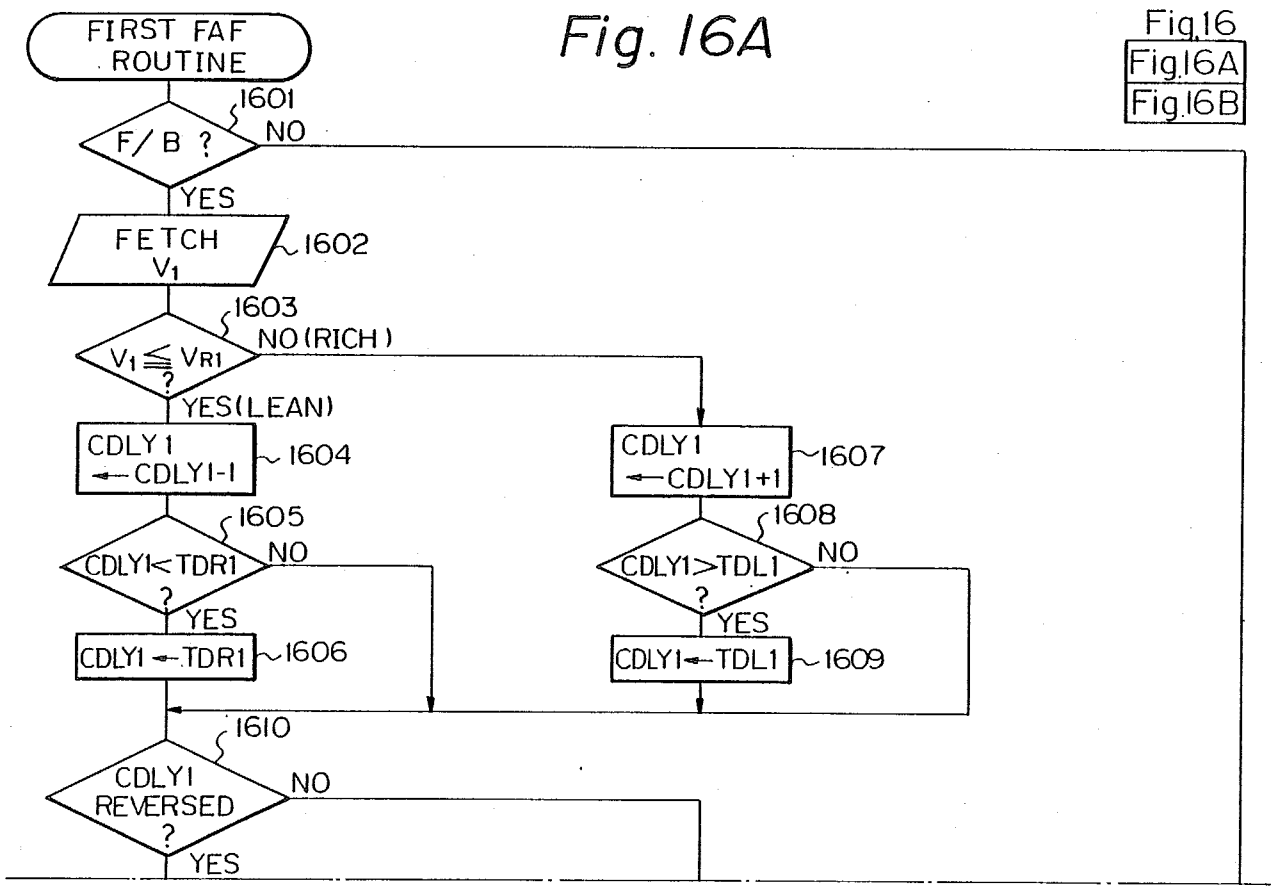
Figure 16B:
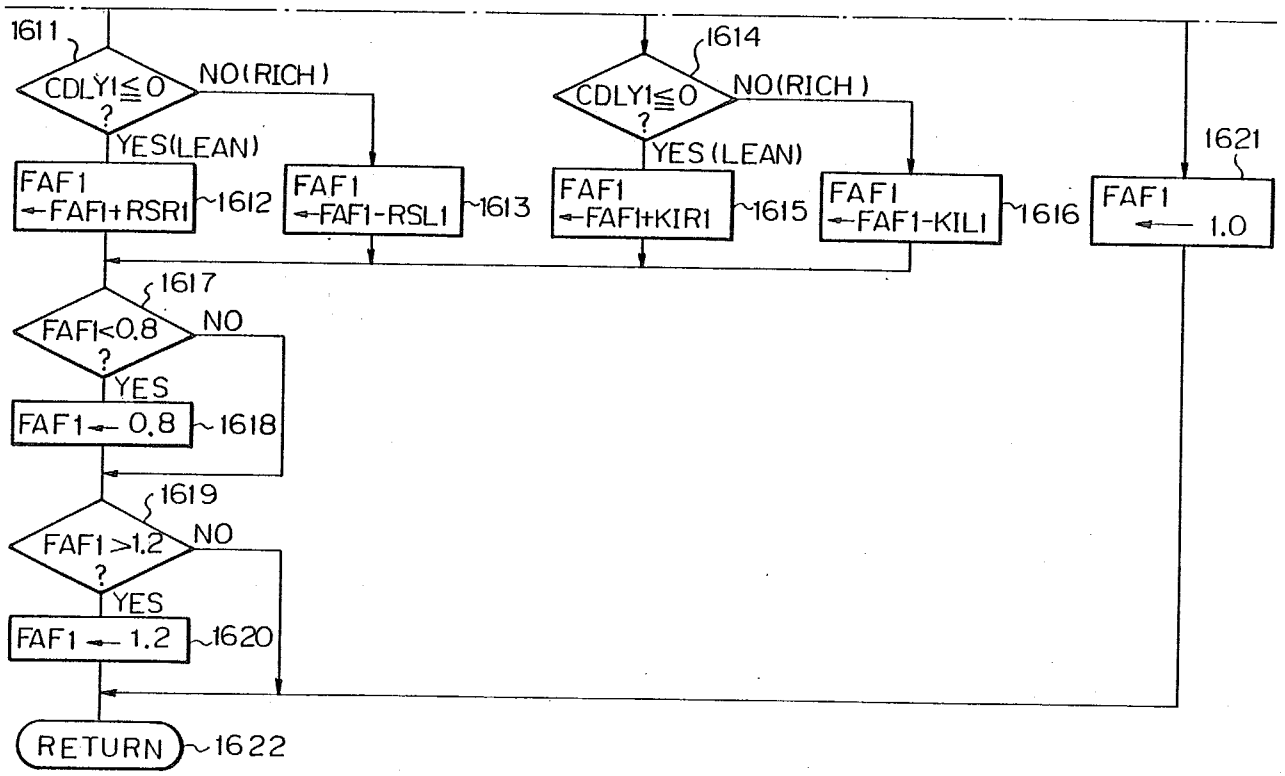

In FIG. 16, which is a modification of FIG. 6, a delay operation different from that of FIG. 6 is carried out. In FIG. 16, steps 1601, 1602, 1612, 1613, 1615, 1616, 1617, 1618, 1619, 1620, and 1621 correspond to steps 601, 602, 618, 619, 621, 622, 623, 624, 625, 626, and 627, respectively, of FIG. 6. That is, at step 1603, if $V_1 \leqq V_{R1}$, which means that the current air-fuel ratio is lean, the control proceeds to step 1604 which decreases a first delay counter CDLY1 by 1. Then, at steps 1605 and 1606, the first delay counter CLDY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value. On the other hand, if $V_1 > V_{R1}$, which means that the current air-fuel ratio is rich, the control proceeds to step 1 604 which increases the first delay counter CDLY1 by 1. Then, at steps 1607 and 1608, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Note that, in this case, if CDLY1 $\geqq 0$, this means that the delayed air-fuel ratio is rich, while, if CDLY1 $<0$, this means that the delayed air-fuel ratio is lean.

At step 1610, it is determiend whether or not the first delay counter CDLY1 is reversed, i.e., whether the delayed air-fuel ratio is switched from the lean side to the rich side. If reversed, the control proceeds to step 1611 which determines whether or not CDLY1 $\leqq 0$. If CDLY1 $\leqq 0$, so that the delayed air-fuel ratio is switched from the rich side to the lean side, the control proceeds to step 1612 which remarkably increases the air-fuel ratio correction amount FAF1 by a rich skip amount RSR1. Otherwise, the control proceeds to step 1613 which remarkably decreases the air-fuel ratio correction amount FAF1 by a lean skip amount RSL1. Thus, a skip operation is performed upon the air-fuel ratio correction amount FAF1.

On the other hand, at step 1610, if the first delay counter CDLY1 is not reversed, an integration operation is performed upon the air-fuel ratio correction amount FAF1 by steps 1614, 1615, and 1616. That is, at step 1614, it is determiend whether or not CDLY1 is negative. As a result, if CDLY1 $<0$ (lean), the control proceeds to step 1615 which gradually increases the air-fuel ratio correction amount FAF1 by a rich integration amount KIR1, while if CDLY1 $\geqq 0$ (rich), the control proceeds to step 1616 which gradually decreases the air-fuel ratio correction amount FAF1, by a lean integration amount KIL1. Note that the integration amount KIR1 (KIL1) is smaller than the skip amount RSR1 (RSL1).

The calculated correction amount FAF1 is guarded by the maximum value 1.2 and the minimum value 0.8 in the same way as in steps 623 to 626 of FIG. 6.

Figures 17A, 17B, 17C, 17D:
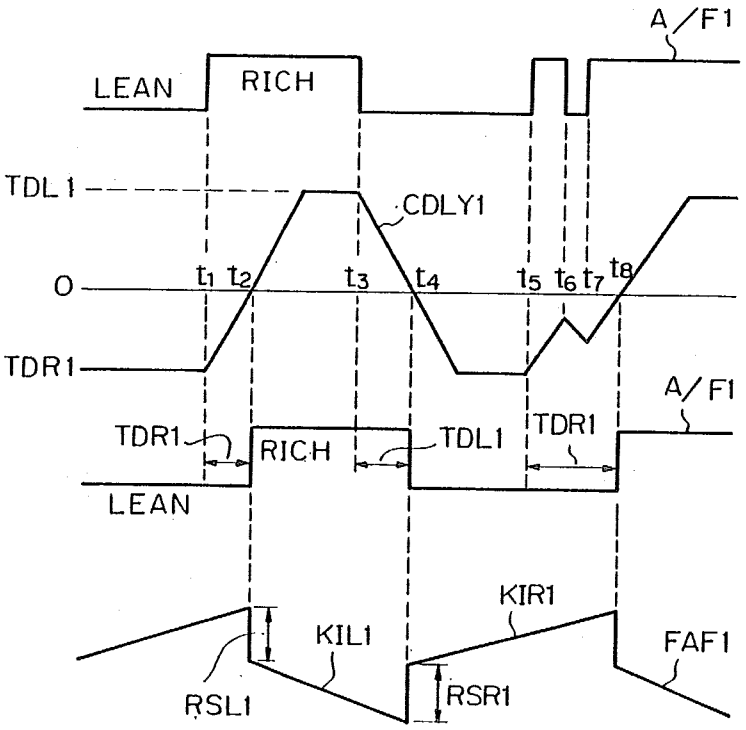
FIGS. 17A through 17D are timing diagrams explaining the flow chart of FIG. 16.

The operation by the flow chart of FIG. 16 will be further explained with reference to FIGS. 17A through 17D. As illustrated in FIG. 7A, when the air-fuel ratio A/F1 is obtained by the output of the upstream-side $O_2$ sensor 13, the first delay counter CDLY1 is counted up during a rich state, and is counted down during a lean state, as illustrated in FIG. 17B. As a reesult, the delayed air-fuel ratio A/F1′ is obtained as illustrated in FIG. 17C. For example, at time $t_1$, even when the air-fuel A/F1 is changed from the lean side to the rich side, the delayed air-fuel ratio A/F1′ is changed at time $t_2$ after the rich delay time period TDR1. Similarly, at time $t_3$, even when the air-fuel ratio A/F1 is changed from the rich side to the lean side, the delayed air-fuel ratio A/F1′ is changed at time $t_4'$ after the lean delay time period TDL1. However, at time $t_5$, $t_6$, or $t_7$, when the air-fuel ratio A/F is reversed at time $t_8$. That is, the delayed air-fuel ratio A/F1′ is stable when compared with the air-fuel ratio A/F1. Further, as illustrated in FIG. 17D, at every change of the delayed air-fuel ratio A/F1′ from the rich side to the lean side, or vice versa, the correction amount FAF1 is skipped by the skip amount RSR1 or RSL1, and also, the correction amount FAF1 is gradually increased or decreased in accordance with the delayed air-fuel ratio A/F1′.

Figure 18A:
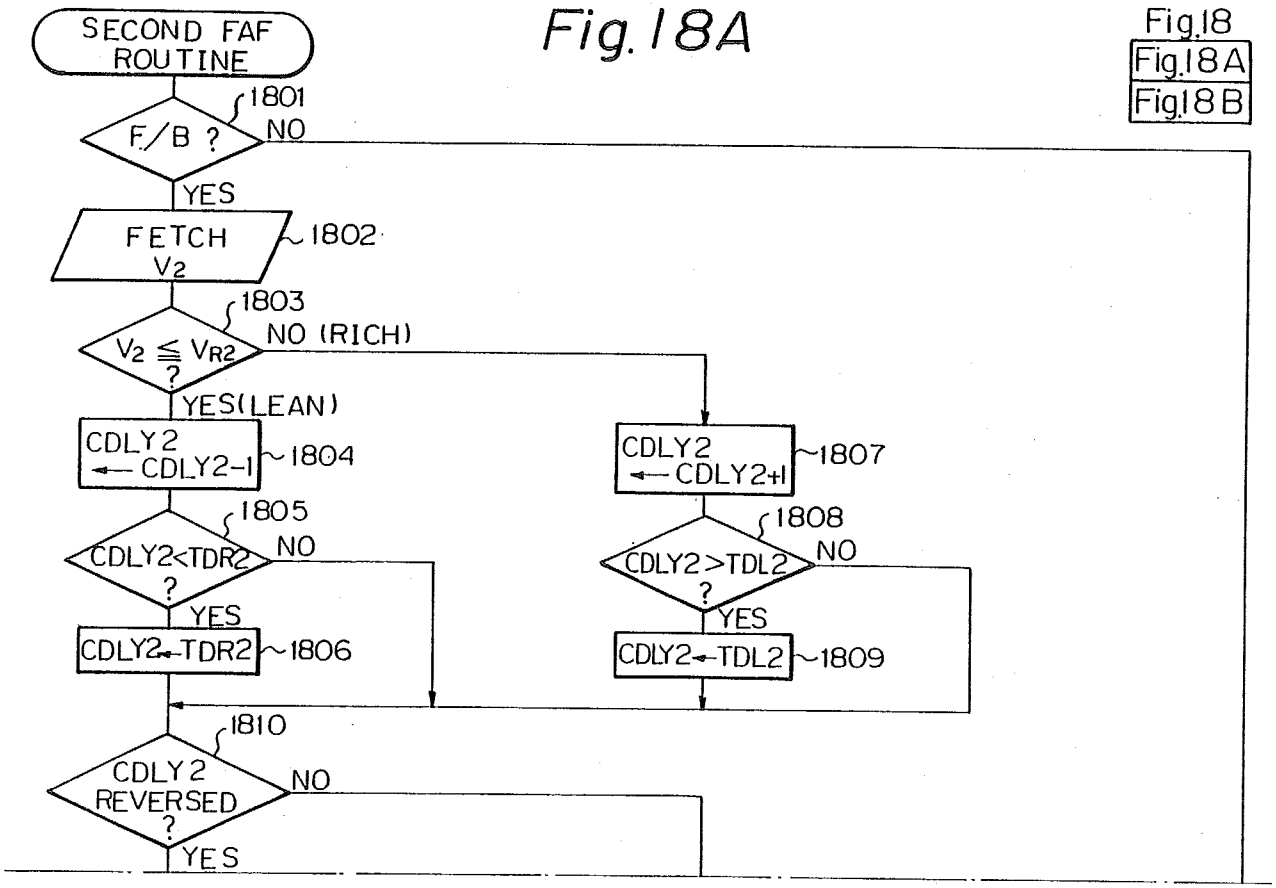
Figure 18B:
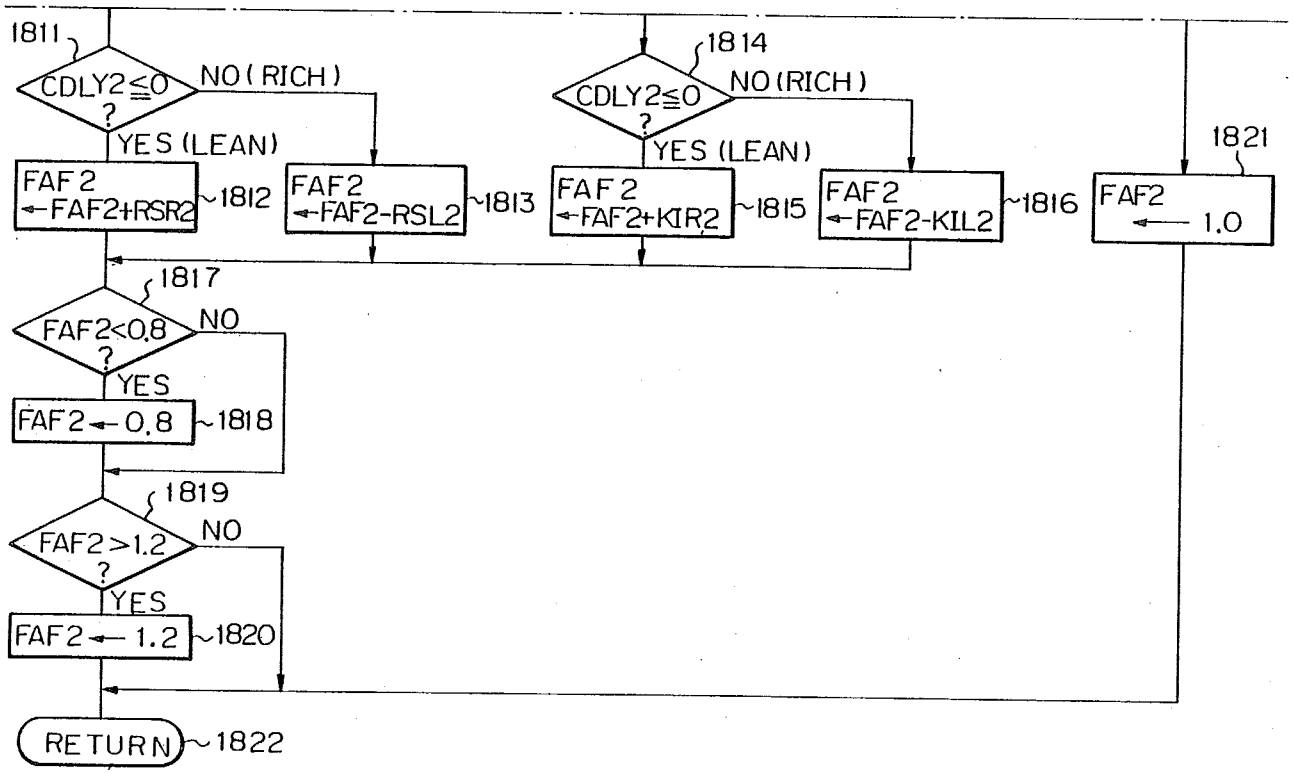
Figures 19, 19A:
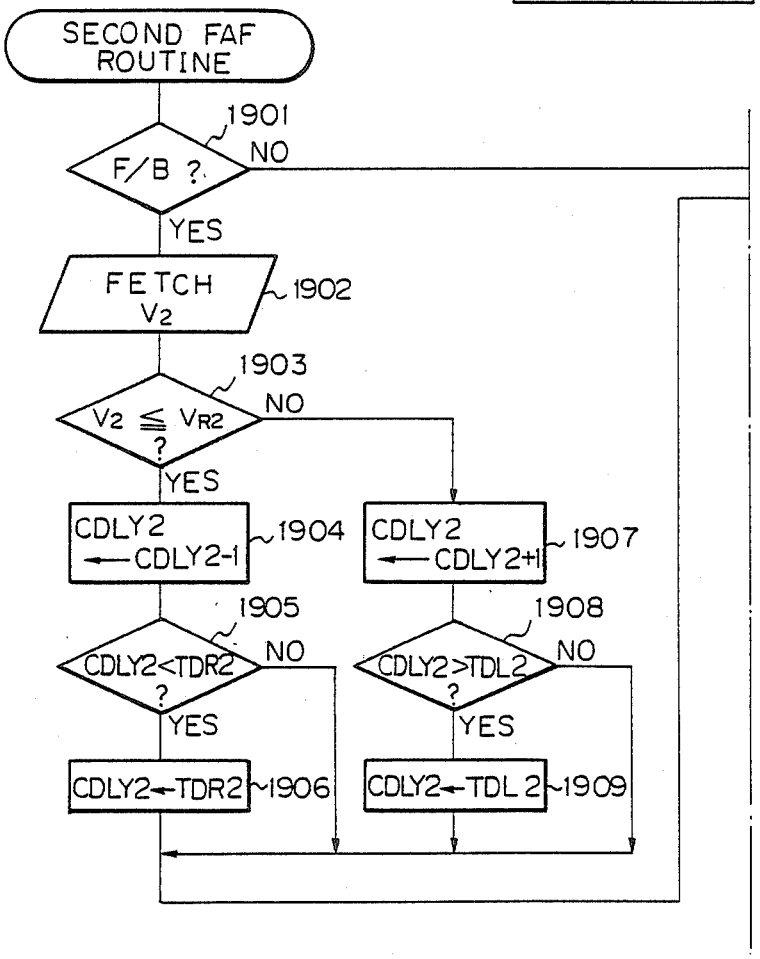

FIG. 18 is a modification of FIG. 8, and FIG. 19 is a modification of FIG. 13. That is, in FIGS. 18 and 19, the same delay operation as in FIG. 16 is carried out. Note that, in FIG. 19, no skip operation is performed upon the delay time periods TDR1 and TDL1. The detailed explanation of FIGS. 18 and 19 is omitted.

Also, the first air-fuel ratio feedback control by the upstream-side $O_2$ sensor 13 is carried out at every relatively small time period, such as 4 ms, and the second air-fuel ratio feedback control by the down-stream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the skip amounts RSR1 and RSL1, the integration amounts KIR1 and KIL1, or the reference voltage $V_{R1}$, are variable.

Figure 13C:
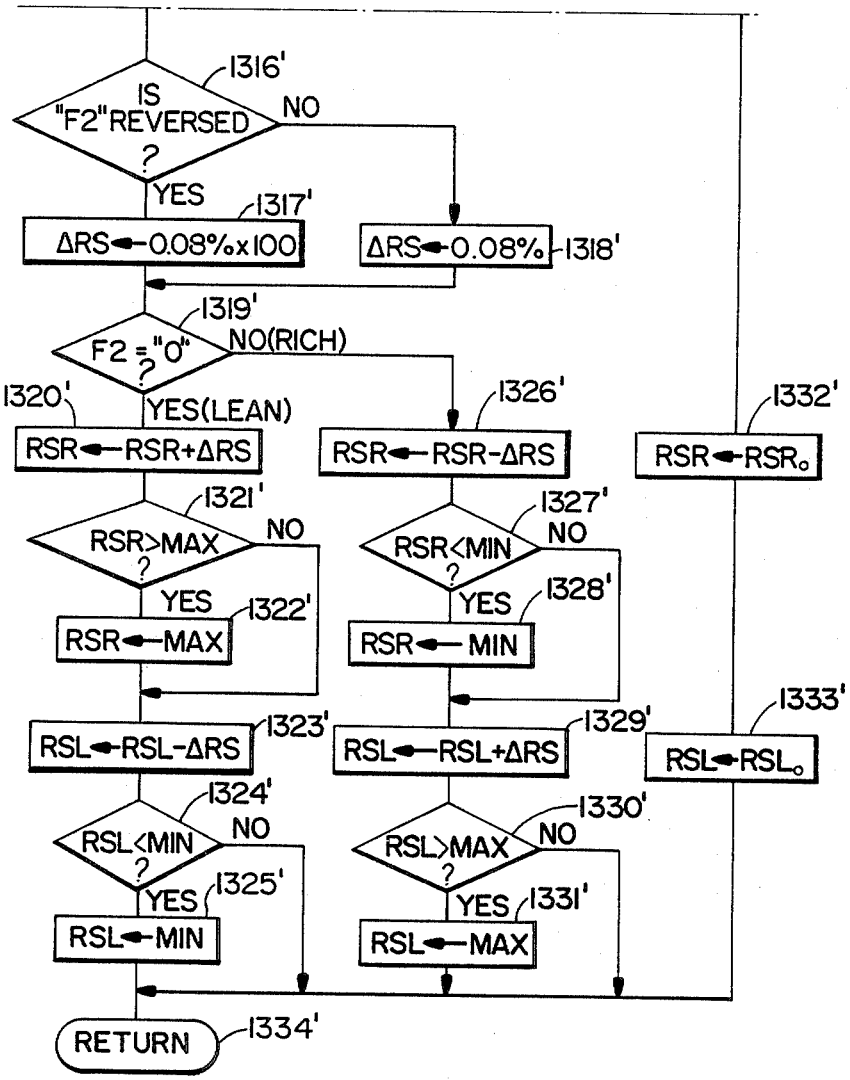
Figure 13D:
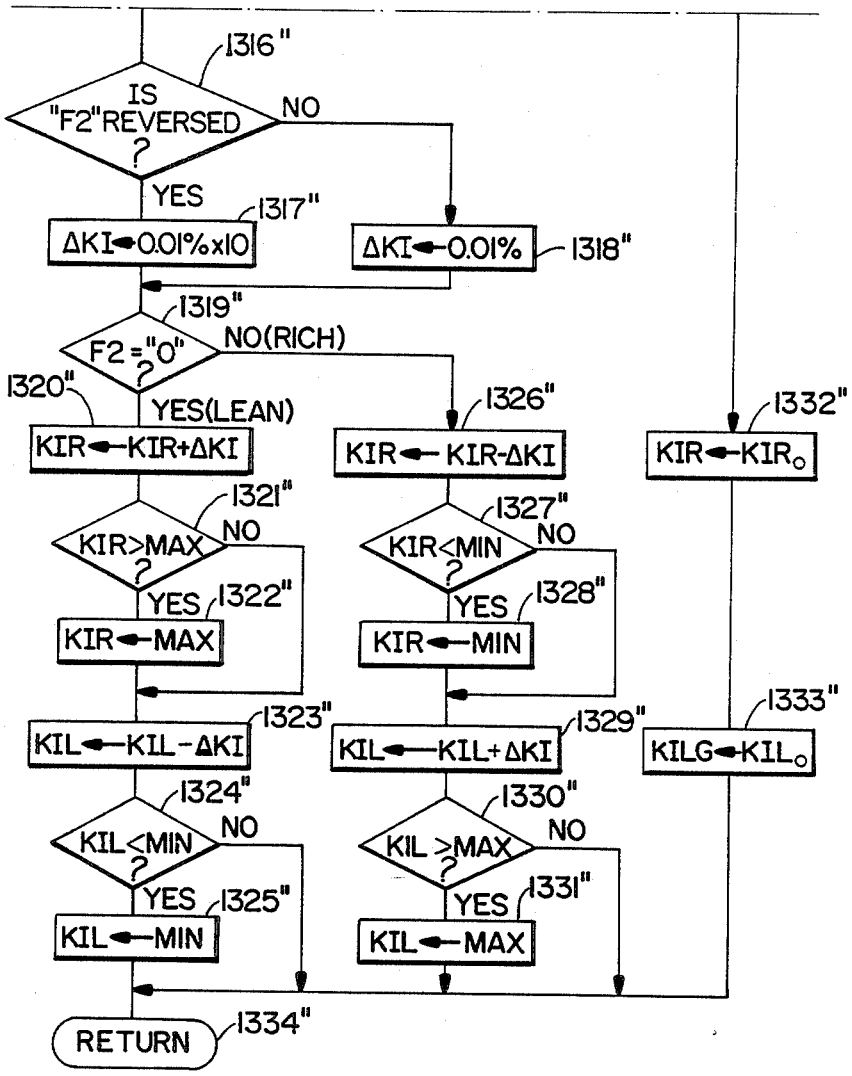
Figure 19B:
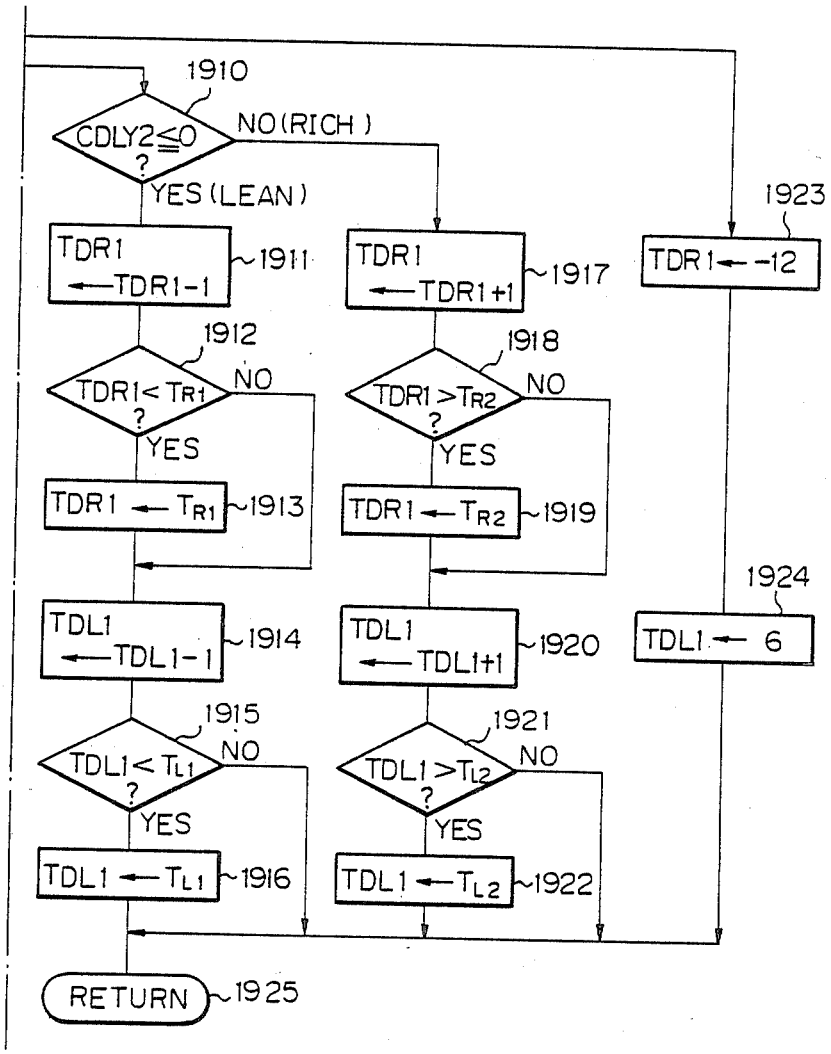
Figure 19C:
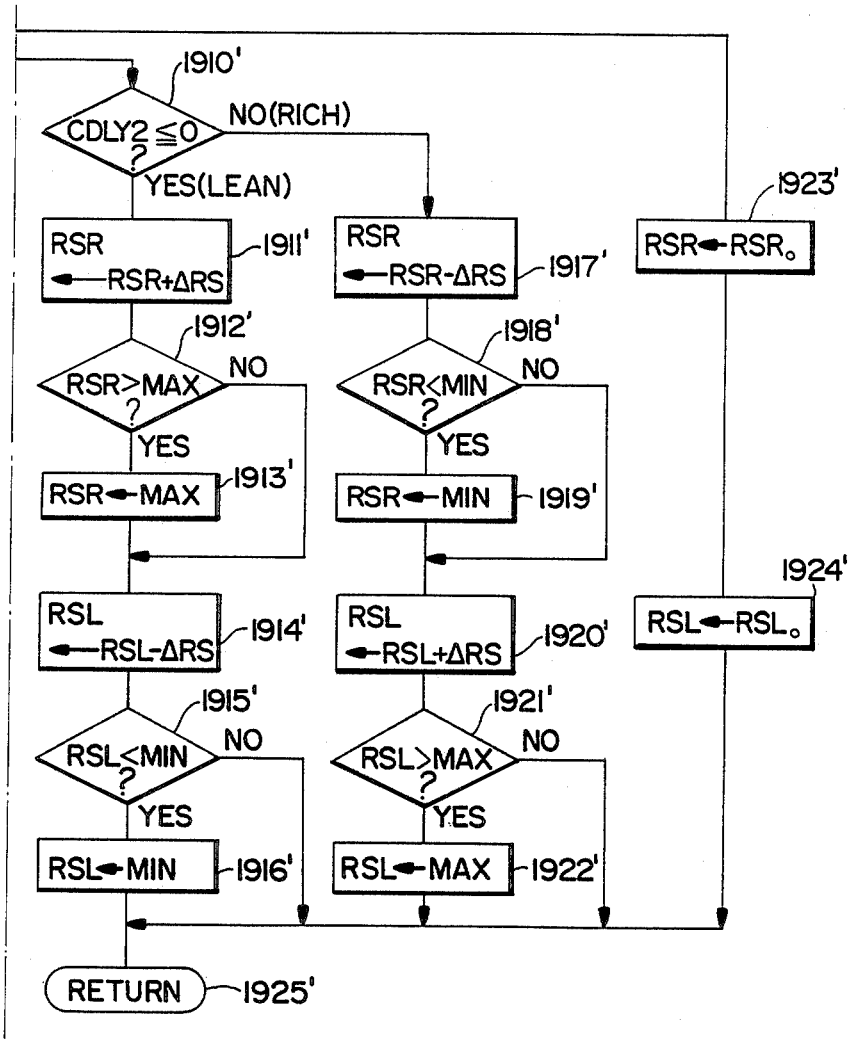
Figure 19D:
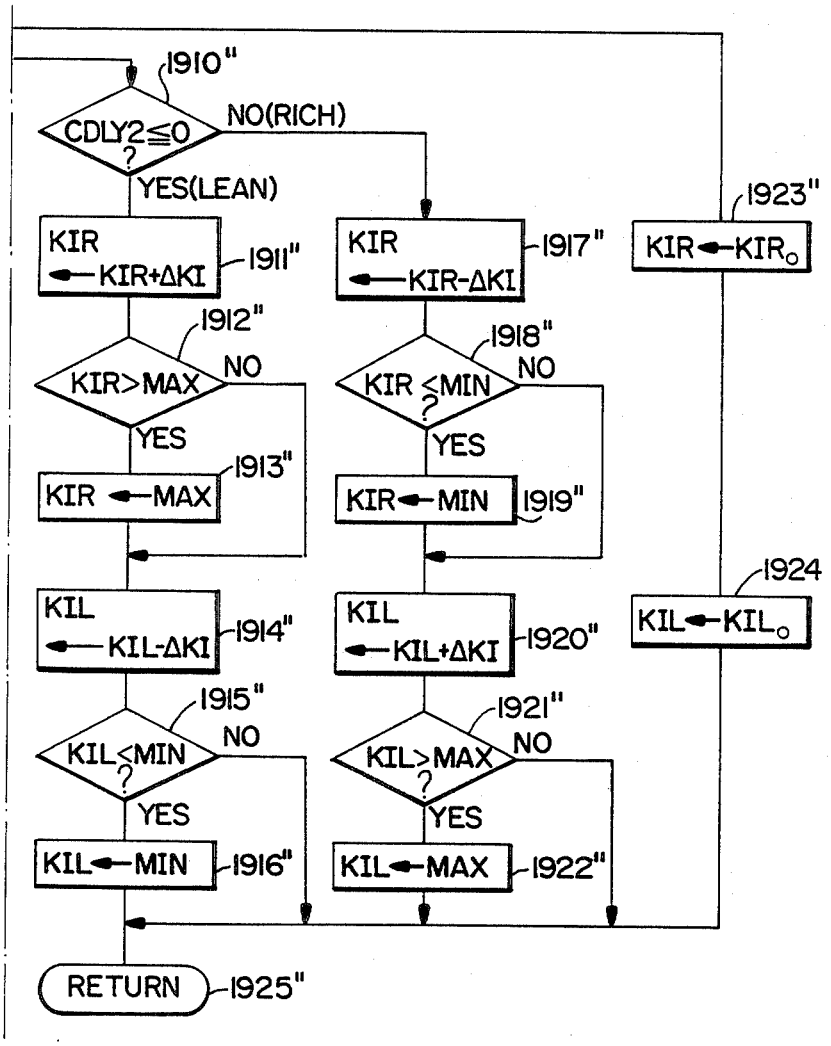

For example, FIGS. 13C and 13D illustrate the routine of FIG. 13B using skip amounts RS and integration amounts KI, respectively. Likewise, FIGS. 19C and 19D illustrate the routine of FIG. 19B using skip amounts RS and integraton amounts KI, respectively. In FIGS. 13C and 19C, the same reference numerals as FIGS. 13B and 19B, respectively, are identified with a single prime notation (e.g., step 1320' in FIG. 13C or step 1911' in FIG. 19C). In FIGS. 13D and 19D, the same reference numerals FIGS. 13B and 19B, respectively, are identified with a double prime notation (e.g., step 1320" in FIG. 13D and step 1911" in FIG. 19D).

In steps 1332' and 1333' of FIG. 13C and steps 1923' and 1924' of FIG. 19C, the rich skip amount RSR and lean skip amount RSL are set to definite values $RSR_o$, $RSL_o$, corresponding to the definite values inputted for TDR1 and TDL1 of steps 1332 and 1333 of FIG. 13B, thereby carrying out open loop control for the downstream side $O_2$ sensor I5. Similarly, the rich integration amount KIR and lean integration amount KIL are set in steps 1332" and 1333" of FIG. 13D and steps 1923" and 1924" of FIG. 19D to definite values $KIR_o$, $KIL_o$ to carry out open loop control. In closed loop control, the change in the skip amount ΔRS or integration amount ΔKI are set in steps 1317' and 1318' of FIG. 13C and steps 1317" and 1318" of FIG. 13D to levels such as 0.08%×10 or 0.08% for ΔRS and 0.01%×10 or 0.01% for ΔKI depending on whether the flag F2 is reversed. The setting of ΔRS and ΔKI corresponds to the setting of the parameter k in steps 1317 and 1318 of FIG. 13B. The parameters ΔRS, ΔKI are used for correcting the skip amounts RSR, RSl or integration amounts KIR, KIL, respectively, either by a remarkable change (ΔRS=0.8% or ΔKI=0.1% or gradual change (ΔRS=0.08% or ΔKI=0.01%). The skip amounts RSR, RSL and integration amounts KIR, KIL are guarded in steps 1321', 1324', 1329' and 1330' of FIG. 13C, or steps 1321", 1324", 1329" and 1330" of FIG. 13D by maximum and minimum amount MAX, MIN which correspond to the maximum and minimum values $T_{R1}$, $T_{L1}$ and $T_{R2}$, $T_{L2}$ of FIG. 13B.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 901 of FIG. 9 or at step 1401 of FIG. 14 is determined by the carburetor itself, i.e., the intake air negative pressure and the engine speed, and the air amount corresponding to TAU at step 903 of FIG. 9 or at step 1403 of FIG. 14.

Further, a CO sensor, a lean-mixture sensor or the like can be also used instead of the $O_2$ sensor.

As explained above, according to the present invention, even when the output of the downstream-side air-fuel ratio sensor ($O_2$ sensor) is often reversed within a short period of time, a proper air-fuel ratio control operation by the downstream-side air-fuel ratio sensor can be carried out, and in addition, reduction of the control speed can be improved.

We claim:

1. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel rato sensor with a first fixed reference voltage;

performing a delay operation upon the comparison result of the output of said upstream-side air-fuel ratio sensor with said first fixed reference voltage;

comparing the output of said downstream-side air-fuel ratio sensor with a second fixed reference voltage;

performing a delay operation upon the comparison result of the output of said downstream-side air-fuel ratio sensor with said second fixed reference voltage; and adjusting an actual air-fuel ratio in accordance with the delayed comparison results of the outputs of said upstream-side and downstream-side air-fuel ratio sensors with said first and second fixed reference voltages, respectively.

2. A method as set forth in claim 1, wherein said first fixed reference voltage is different from said second fixed reference voltage.

3. A method as set forth in claim 1, wherein said first fixed reference voltage is a level corresponding to a lean air-fuel ratio, and said second fixed reference voltage is a level corresponding to the stoichiometric air-fuel ratio.

4. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first fixed reference voltage;

performing a delay operation upon the comparison result of the output of said upstream-side air-fuel ratio sensor with said first fixed reference;

changing a first air-fuel ratio correction amunt in accordance with the delayed comparison result of the output of said upstream-side air-fuel ratio sensor with said first fixed reference voltage;

comparing the output of said downstream-side air-fuel ratio sensor with a second fixed reference voltage;

performing a delay operation upon the comparison result of the output of said downstream-side airfuel ratio sensor with said fixed second reference voltage;

changing a second air-fuel ratio correction amount in accordance with the delayed comparison result of the output of said downstream side air-fuel ratio sensor with said second reference voltage; and adjusting an actual air-fuel ratio in accordance with said first and second air-fuel ratio correction amounts.

5. A method as set forth in claim 4 wherein said first fixed reference voltage is different from said second fixed reference voltage.

6. A method as set forth in claim 4, wherein said first fixed reference voltage is a level corresponding to a lean air-fuel ratio, and said second fixed reference voltage is a level corresponding to the stoichiometric air-fuel ratio.

7. A method as set forth in claim 4, further comprising a step of prohibiting a change of said second air-fuel ratio correction amount at a switching of the delayed comparison result of the output of said downstream side air-fuel ratio sensor between the lean side and the rich side.

8. A method for controlling the air-fuel ratio in an internal combustion engine having a catalyst converter for removing pollutants in the exhaust gas thereof, and upstream-side and downstream side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first fixed reference voltage;

generating a first delay signal by performing a delay operation upon the comparison result of the output of said upstream-side air-fuel ratio sensor with said first fixed reference voltage;

changing an air-fuel ratio correction amount in accordance with said first delay signal;

comparing the output of said downstream-side air-fuel ratio sensor with a second fixed reference voltage;

generating a second delay signal by performing a delay operation upon the comparison result of the output of said downstream-side air-fuel ratio sensor with said second fixed reference voltage;

changing a rich skip amount and/or a lean skip amount in accordance with said second delay signal, said air-fuel ratio correcting amount being remarkably increased by said rich skip amount at a switching of the comparison result of said upstream-side air-fuel ratio sensor from the rich side to the lean side, said air-fuel ratio correction amount being remarkably decreased by said lean skip amount at a switching of the comparison result of said upstream-side air-fuel ratio sensor from the lean side to the rich side; and adjusting an actual air-fuel ratio in accordance with said air-fuel ratio correction amount.

9. A method as set forth in claim 8, wherein said first fixed reference voltage is different from said second fixed reference voltage.

10. A method as set forth in claim 8, wherein said first fixed reference voltage is a level corresponding to a lean air-fuel ratio, and said second fixed reference voltage is a level corresponding to a stoichiometric air-fuel ratio.

11. A method as set forth in claim 8, further comprising a step of prohibiting a change of said skip amount at a switching of said second delay signal between the lean side and the rich side.

12. A method for controlling the air-fuel ratio in an internal combustion engine having a catalyst converter for removing pollutants in the exhaust gas thereof, and upstream-side and downstream side air-fuel ratio sensors disposed upstream and downstream, respectively, of said catalyst converter for detecting the concentration of a specific component in the exhaust gas, comprising the steps of:

comparing the output of said upstream-side air-fuel ratio sensor with a first fixed reference voltage;

generating a first delay signal by performing a delay operation upon the comparison result of the output of said upstream-side air-fuel ratio sensor with said first fixed reference voltage;

changing an airfuel ratio correction amount in accordance with said first delay signal;

comparing the output of said downstream-side air-fuel ratio sensor with a second fixed reference voltage;

generating a second delay signal by performing a delay operation upon the comparison result of the output of said downstream-side air-fuel ratio sensor with said second fixed reference voltage;

changing a rich integration amount and/or a lean integration amount in accordance with said second delay signal, said air-fuel ratio correction amount being gradually increased by said rich integration amount at a switching of the comparison result of said upstream-side air-fuel ratio sensor from the rich side to the lean side, said air-fuel ratio correction amount being gradually decreased by said lean integration amount at a switching of the comparison result of said upstream-side air-fuel ratio sensor from the lean side to the rich side; and adjusting an actual air-fuel ratio in accordance with said air-fuel ratio correction amount.

13. A method as set forth in claim 12, wherein said first fixed reference voltage is different from said second fixed reference voltage.

14. A method as set forth in claim 12, wherein said first fixed reference voltage is a level corresponding to a lean air-fuel ratio, and said second fixed reference voltage is a level corresponding to a stoichiometric air-fuel ratio.

15. A method as set forth in claim 12, further comprising step of prohibiting a change of said integration amount at a switching of said second delay signal between the lean side and the rich side.

16. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

comparing the output of said upstream-side air-fuel sensor with a first fixed reference voltage;

generating a first delay signal by performing a delay operation upon the comparison result of the output of said upstream-side air-fuel ratio sensor with said first fixed reference voltage;

changing an air-fuel ratio correction amount in accordance with said first delay signal;

comparing the output of said downstream-side air-fuel ratio sensor with a second fixed reference voltage;

generating a second delay signal by performing a delay operation upon the comparison result of the output of said downstream-side air-fuel ratio sensor with said second fixed reference voltage;

changing a rich delay time period and/or a lean delay time period for said first delay signal in accordance with said second delay signal, the comparison result of said upstream-side air-fuel ratio sensor switched from the lean side to the rich side being delayed by said rich delay time period, the comparison result of said upstream-side air-fuel ratio sensor switched from the rich side to the lean side being delayed by said lean delay time period; and adjusting an actual air-fuel ratio in accordance with said air-fuel ratio correction amount.

17. A method as set forth in claim 16, wherein said first fixed reference voltage is different from said second fixed reference voltage.

18. A method as sest forth in claim 16, wherein said first fixed reference voltage is a level corresponding to a lean air-fuel ratio, and said second fixed reference voltage is a level corresponding to a stoichiometric air-fuel ratio.

19. A method as set forth in claim 16, further comprising a step of prohibiting a change of said delay time period at a switching of said second delay signal between the lean side and the rich side.

20. An apparatus for controlling the air-fuel ratio in an internal combustion engine having a catalyst converter for removing pollutants in the exhaust gas thereof, and upstream-side and downstream-side aair-fuel ratio sensors disposed upstream and downstream, respectively, of said catalyst converter for detecting the concentration of a specific component in the exhaust gas, said apparatus comprising:

means for comparing the output of said upstream side air-fuel ratio sensor with a first fixed reference voltage;

means for a performing a delay operation upon the comparison result of the output of said upstream-side air-fuel ratio sensor with said first fixed reference voltage;

means for comparing the output of said downstream-side air-fuel ratio sensor with a second fixed reference voltage;

means for performing a delay operation upon the comparison result of the output of said downstream-side air-fuel ratio sensor with said second fixed reference voltage; and means for adjusting an actual air-fuel ratio in accordance with the delayed comparison results of the outputs of said upstream-side and downstream-side air-fuel ratio sensors with said first and second fixed reference voltages, respectively.

21. The apparatus as set forth in claim 20, wherein said first fixed reference voltage is different from said second fixed reference voltage.

22. The apparatus as set forth in claim 20, wherein said first fixed reference voltage is a level corresponding to a lean air-fuel ratio, and said second fixed reference voltage is a level corresponding to the stoichiometric air-fuel ratio.

23. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, said apparatus comprising:

means for comparing the output of said upstream-side air-fuel ratio sensor with a first fixed reference voltage;

means for performing a delay operation upon the comparison result of the output of said upstream-side air-fuel ratio sensor with said first fixed reference;

means for changing a first air-fuel rato correction amount in accordance wiht the delayed comparison result of the output of said upstream-side air-fuel ratio sensor with said first fixed reference voltage;

means for comparing the output of said downstream-side air-fuel ratio sensor with a second fixed reference voltage;

means for performing a delay operation upon the comparison result of the output of said downstream-side air-fuel ratio sensor with sid fixed second reference voltage;

means for changing a second air-fuel ratio correction amount in accordance ith the delayed comparison result of the output of said downstream side air-fuel ratio sensor with said second reference voltage; and means for adjusting an actual air-fuel ratio in accordance with said first and second and second air-fuel ratio correction amounts.

24. The apparatus as set forth in claim 23 wherein said first fixed reference voltage is different from said second fixed reference voltage.

25. The apparatus as set forth in claim 23, wherein said first fixed reference voltage is a level corresponding to a lean air-fuel ratio, and said second fixed reference voltage is a level corresponding to the stoichiometric air-fuel ratio.

26. The apparatus as set forth in claim 23, further comprising a step of prohibiting a change of said second air-fuel ratio correction amount at a switching of the delayed comparison result of the output of said downstream side air-fuel ratio sensor between the lean side end the rich side.

27. An apparatus for controlling the air-fuel ratio in an internal combustion engine having a catalyst converter for removing pollutants in the exhaust gas thereof, and upstream-side and downstream side air-fuel ratio sensors disposed upstream and downstream, respectively, of said catalyst converter for detecting the concentration of a specific component in the exhaust gas, said apparatus comprising:

means for comparing the output of said upstream-side air-fuel ratio sensor with a first fixed reference voltage;

means for generating a first delay signal by performing a delay operation upon the comparison result of the output of said upstream-side air-fuel ratio sensor with said first fixed reference voltage;

means for changing an air-fuel ratio correction amount in accordance with said first delay signal;

means for comparing the output of said downstream-side air-fuel ratio sensor with a second fixed reference voltage;

means for generating a second delay signal by performing a delay operation upon the comparison result of the output of said downstream-side air-fuel ratio sensor with said second fixed reference voltage;

means for changing a rich skip amount and/or a lean skip amount in accordance with said second delay signal, said air-fuel ratio correcting amount being remarkably increased by said rich skip amount at a switching of the comparison result of said upsteam-side air-fuel ratio sensor from the rich side to the lean side, said air-fuel ratio correction amount being remarkably decreased by said lean skip amount at a switching of the comparison result of said upstream-side air-fuel ratio sensor from the lean side to the rich side; and means for adjusting an actual air-fuel ratio in accordance with said air-fuel ratio correction amount.

28. The apparatus as set forth in claim 27, wherein said first fixed reference voltage is different from said second fixed reference voltage.

29. The apparatus as set forth in claim 27, wherein said first fixed reference voltage is a level corresponding to a lean air-fuel ratio, and said second fixed reference voltage is a level corresponding to a stoichiometric air-fuel ratio.

30. The apparatus as set forth in claim 27, further comprising a step of prohibiting a change of said skip amount at a switching of said second delay signal between the lean side and the rich side.

31. An apparatus for controlling the air-fuel ratio in an internal combustion engine having a catalyst converter for removing pollutants in the exhaust gas thereof, and upstream-side an downstream side air-fuel ratio sensors disposed upstream and downstream, respectively, of said catalyst converter for detecting the concentration of a specific comonent in the exhaust gas, comprising:

means for comparing the output of said upstream-side air-fuel ratio sensor with a first fixed reference voltage;

means for generating a first delay signal by performing a delay operation upon the comparison result of the output of said upstream-side air-fuel ratio sensor with said first fixed reference voltage;

means for changing an air-fuel ratio correction amount in accordance with said delay signal;

means for comparing the output of said downstream-side air-fuel ratio sensor with a second fixed reference voltage;

means for generating a second delay signal by performing a delay operation upon the comparison result of the output of said downstream-side air-fuel ratio sensor with said second fixed reference voltage;

means for changing a rich integration amount and/or a lean integration amount in accordance with said second delay signal, said air-fuel ratio correction amount being gradually increased by said rich integration amount at a switching of the comparison result of said upstream-side air-fuel ratio sensor from the rich side to the lean side, said air-fuel ration correction amount being gradually decreased by said lean integration amount at a switching of the comparison result of said upstream-sie air-fuel ratio sensor from the lean side to the rich side; and means for adjusting an actual air-fuel ratio in accordance with said air-fuel ratio correction amount.

32. The apparatus as set forth in claim 31, wherein said first fixed reference voltage is different from said second fixed reference voltage.

33. The apparatus as set forth in claim 31, wherein said first fixed reference voltage is a level corresponding to a lean air-fuel ratio, and said second fixed reference voltage is a level corresponding to a stoichiometric air-fuel ratio.

34. The apparatus as set forth in claim 31, further comprising step of prohibiting a change of said integration amount at a switching of said second delay signal between the lean side and the rich side.

35. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, said apparatus comprising:

means for comparing the output of said upstream-side air-fuel sensor with a first fixed reference voltage;

means for generating a first delay signal by performing a delay operation upon the comparison result of the output of said upstream-side air-fuel ratio sensor with said first fixed reference voltage;

means for changing an air-fuel ratio correction amount in accordance with said first delay signal;

means for comparing the output of said downstream-side air-fuel ratio sensor with a second fixed reference voltage;

means for generating a second delay signal by performing a delay operation upon the comparison result of the output of said downstream-side air-fuel ratio sensor with said second fixed reference voltage;

means for changing a rich delay time period and/or a lean delay time period for said first delay signal in accordance with said second delay signal, the comparison result of said upstream-side air-fuel ratio sensor switched from the lean side to the rich side being delayed by said rich delay time period, the comparison result of said upstream-side air-fuel ratio sensor switched from the rich side to the lean side being delayed by said lean delay time period; and means for adjusting an actual air-fuel ratio in accordance with said air-fuel ratio correction amount.

36. The apparatus as set forth in claim 35, wherein said first fixed reference voltage is different from said second fixed reference voltage.

37. The apparatus as set forth in claim 35, wherein said first fixed reference voltage is a level corresponding to a lean air-fuel ratio, and said second fixed reference voltage is a level corresponding to a stoichiometric air-fuel ratio.

38. The apparatus as set forth in claim 35, further comprising a step of prohibiting a change of said delay time period at a switching of said second delay signal between the lean side and the rich side.

* * * * *